US009070967B2

(12) United States Patent
Orime et al.

(10) Patent No.: US 9,070,967 B2
(45) Date of Patent: Jun. 30, 2015

(54) ANTENNA AND COMBINATION ANTENNA

(75) Inventors: Nobutake Orime, Tokyo (JP); Naotaka Uchino, Tokyo (JP); Daisuke Inoue, Tokyo (JP); Yoichi Iso, Tokyo (JP)

(73) Assignees: FURUKAWA ELECTRIC CO., LTD., Tokyo (JP); FURUKAWA AUTOMOTIVE SYSTEMS INC., Inukami-gun (JP)

( * ) Notice: Subject to any disclaimer, the term of this patent is extended or adjusted under 35 U.S.C. 154(b) by 272 days.

(21) Appl. No.: 13/606,539

(22) Filed: Sep. 7, 2012

(65) Prior Publication Data

US 2013/0241778 A1 Sep. 19, 2013

Related U.S. Application Data

(63) Continuation of application No. PCT/JP2011/056160, filed on Mar. 16, 2011.

(30) Foreign Application Priority Data

Mar. 23, 2010 (JP) ..... 2010-065596

(51) Int. Cl.

| | |
|---|---|
| ***H01Q 1/38*** | (2006.01) |
| ***H01Q 9/04*** | (2006.01) |
| ***H01Q 25/02*** | (2006.01) |
| ***H01Q 1/52*** | (2006.01) |
| ***H01Q 15/00*** | (2006.01) |
| ***H01Q 21/06*** | (2006.01) |

(52) U.S. Cl.

CPC . *H01Q 9/04* (2013.01); *H01Q 1/38* (2013.01); *H01Q 25/02* (2013.01); *H01Q 1/525* (2013.01); *H01Q 15/006* (2013.01); *H01Q 21/062* (2013.01)

(58) Field of Classification Search

CPC ..... H01Q 1/38; H01Q 21/06; H01Q 21/061; H01Q 21/065; H01Q 15/0006; H01Q 15/006; H01Q 1/5251; H01Q 21/062

USPC ..... 343/700 MS

See application file for complete search history.

(56) References Cited

U.S. PATENT DOCUMENTS 7,623,073 B2 * 11/2009 Teshirogi et al. ..... 343/700 MS
7,639,183 B2 * 12/2009 Teshirogi et al. ..... 343/700 MS (Continued)

FOREIGN PATENT DOCUMENTS

CN 101345347 A 1/2009
EP 1 471 598 A1 7/2003

(Continued)

OTHER PUBLICATIONS

International Search Report mailed Jun. 21, 2011 in PCT/JP2011/056160 filed Mar. 16, 2011 (in English).

(Continued)

*Primary Examiner* — Hoang V Nguyen

(74) *Attorney, Agent, or Firm* — Oblon, McClelland, Maier & Neustadt, L.L.P.

(57) ABSTRACT

Provided are an antenna and a combination antenna having a wide directivity in a predetermined plane direction. The antenna 100 is configured to have rims 111, 112 at left and right ends of a dielectric substrate 101 in the X direction in such a manner as to sandwich antenna elements 10. The rims 111, 112 may be metal plates or EBGs. As the rims 111, 112 are thus provided at both sides to sandwich the antenna elements 10, it is possible to reduce the width of the dielectric substrate 101 of the antenna 100 required for realizing wide coverage. As a result, it is possible to create a greater space for integration of another RF circuit and improve the space factor.

9 Claims, 32 Drawing Sheets

(56) References Cited

U.S. PATENT DOCUMENTS

| | | | | |
|---|---|---|---|---|
| 7,847,737 | B2 | 12/2010 | Kuroda | |
| 2005/0001757 | A1 | 1/2005 | Shinoda et al. | |
| 2005/0128134 | A1 | 6/2005 | Shinoda et al. | |
| 2008/0136710 | A1 | 6/2008 | Nefedov et al. | |
| 2009/0015499 | A1 | 1/2009 | Kuroda | |
| 2009/0079637 | A1* | 3/2009 | Fukui et al. | 343/700 MS |
| 2009/0085827 | A1 | 4/2009 | Orime et al. | |
| 2009/0153433 | A1 | 6/2009 | Nagai et al. | |
| 2010/0039343 | A1* | 2/2010 | Uno et al. | 343/818 |

FOREIGN PATENT DOCUMENTS

| | | |
|---|---|---|
| EP | 1 962 377 A1 | 8/2006 |
| JP | 2005-94440 | 4/2005 |
| JP | 2006-145444 | 6/2006 |
| JP | 2007-243375 | 9/2007 |
| JP | 2009-89212 | 4/2009 |

OTHER PUBLICATIONS

Takashi Kawamura et al., "Broadening of Notch in the Restricted Band for UWB Radar Antenna", Institute of Electronics Information and Communication Engineers, General Conference 2006, B-1-120, p. 120.

Office Action issued on Mar. 19, 2014 in the corresponding Chinese patent Application No. 201180010333.7 (with English Translation).

Extended Search Report issued Dec. 30, 2014 in European Patent Application No. 11759268.3.

Office Action issued Nov. 28, 2014 in Japanese Patent Application No. 2012-506958 (with English Translation).

* cited by examiner

ANTENNA AND COMBINATION ANTENNA

TECHNICAL FIELD

The present invention relates to an antenna and a combination antenna having a wide directivity in a horizontal direction.

BACKGROUND ART

With popularization of air bags and perfect duty to wear a seatbelt, the number of fatalities due to vehicle traffic accidents tends to decrease. However, because of increase in senior drivers due to aging, the number of traffic accidents and the number of injured persons still tend to be large. In view of such a background, for the purpose of assisting driving, attention is given to a sensor to detect any obstacle around a vehicle. So far, such sensors have been commercialized as ultrasonic sensors, cameras, milli-meter wave radars and the like.

A conventional vehicle-mounted radar can detect an obstacle that exists at a middle distance of less than 30 m or at a great distance of less than 150 m. However, for an obstacle at a short distance of less than 2 m, for example, its detection problematically has a large margin of error. In order to detect the obstacle near the vehicle precisely, there is a demand for the practical use of a UWB radar which has high axial resolution and ensures broader view.

The patent literature 1 (PL1) discloses an array antenna in which antenna elements are arranged in a 2×4 pattern. As an antenna element, disclosed is a printed antenna element formed by printing on a substrate. FIG. 30 illustrates an example of an array antenna formed by printing a plurality of printed antenna elements on the substrate together. FIG. 30A illustrates a linear array antenna 900*a* in which printed antenna elements 901 are arranged in a 1×4 pattern and FIG. 30B illustrates an array antenna 900*b* in which printed antenna elements 901 are arranged in a 2×4 pattern. Each printed antenna element 901 has one radiating element 902 and one second ground plane 903, which are printed on the substrate as one group. The Eθ component of the antenna element 901 is arranged in a vertical direction perpendicular to the radiation surface.

In these radars, a phase comparison monopulse system is used to measure a horizontal azimuthal angle of an object to detect around the vehicle. In the phase comparison monopulse system, reception signals received at two antennas arranged in the horizontal direction are used as a basis to obtain a value by normalizing a difference signal of both reception signals by a sum signal of the reception signals. Then, the value is applied to preset discrimination curve (monopulse curve) thereby to obtain a deviation angle in the vertical direction on the antenna plane.

Besides, the non-patent literature (NPL1) discloses an UWB radar antenna 910 as illustrated in FIG. 31. The antenna 910 is a linear antenna in which antennal elements 911 are arranged in a 1×4 pattern. Each antenna element 911 uses as a radiating element 912 a wide-coverage bowtie antenna by linear polarized wave, around which cavities 914 are provided with rims. In rims 915, through holes 916 electrically connected to a ground plane (not shown) are arranged at predetermined pitch.

CITATION LIST

Patent Literature

PL1: Japanese Patent Application Laid-Open No. 2009-89212

Non-Patent Literature

NPL1: "Broadening of Notch in the Restricted Band for UWB Radar Antenna" Kawamura, Maeda, Teshirogi, Takizawa, Hamaguchi, Kouno, Proceedings of the IEICE General Conference of 2006, B-1-120, page 120

SUMMARY OF INVENTION

Technical Problem

However, in the conventional UWB antenna as disclosed in the PL1 or NPL1, it is difficult to realize a wide-coverage antenna for covering a sufficiently wide area (angular range) with antenna beams in the horizontal direction. Particularly, for a radar antenna mounted on a vehicle, there is a need to cover a wide range in a plane (for example, ±90 degrees) with antenna beams, however, such a wide-coverage antenna cannot be achieved.

Then, the present invention was carried out in order to solve the above-mentioned problem and aims to provide an antenna and a combination antenna having a wide directivity in a horizontal direction.

Solution to Problem

A first aspect of an antenna of the present invention is an antenna comprising: a dielectric substrate; at least one antenna element provided on the dielectric substrate and having magnetic current as a main radiating source, the antenna element being arranged such that an Eθ component as main polarized waves is placed in a horizontal direction; and rims made of metal plates or EBGs (Electromagnetic band Gap) with a predetermined periodic structure provided at respective sides on the dielectric substrate in such a manner as to sandwich the antenna element in the horizontal direction.

Another aspect of the antenna of the present invention is characterized in that the antenna element is a printed dipole antenna or a micro strip antenna (patch antenna).

Yet another aspect of the antenna of the present invention is characterized in that the at least one antenna element comprises two or more antenna elements, the antenna elements are arranged in line in a vertical direction, and when a distance between the rims or EBGs arranged at the respective sides of the antenna elements is Asub and free space wavelength of radiation wave of the antenna elements is λ0, the Asub is determined to meet $0.65<Asub/\lambda0<0.85$.

Yet another aspect of the antenna of the present invention is characterized in that the at least one antenna element comprises two or more groups of antenna elements arranged in a vertical direction, each of the groups of the antenna elements having two antenna elements arranged in a horizontal direction, and when a distance between the rims or EBGs arranged at the respective sides of the two or more groups of the antenna elements is Asub and free space wavelength of radiation wave of the antenna elements is λ0, the Asub is determined to meet $0.95<Asub/\lambda0<1.3$.

Yet another aspect of the antenna of the present invention is characterized in that the two antenna elements of each of the two or more groups are arranged symmetric with respect to a center axis that passes between the two antenna elements and are reverse phase fed.

Yet another aspect of the antenna of the present invention is characterized in that the at least one antenna element comprises two or more groups of antenna elements arranged in a vertical direction, each of the groups of the antenna elements having two antenna elements arranged in a horizontal direction, and each of the antenna elements being formed as a ¼ wavelength rectangular patch, when a distance between the rims or EBGs arranged at the respective sides of the two or more groups of the antenna elements is Asub, free space wavelength of radiation wave of the antenna elements is λ0, a relative effective permittivity of the dielectric substrate is ∈eff, and a length a of each of the antenna elements in the horizontal direction meets $$a = \frac{1}{4}\frac{\lambda O}{\sqrt{\varepsilon\ eff}}$$

the Asub is determined to meet $0.95-2a/\lambda 0<Asub/\lambda 0<1.3-2a/\lambda 0$.

Yet another aspect of the antenna of the present invention is characterized in that the rims or EBGs are arranged symmetric or asymmetric with respect to the antenna elements in the horizontal direction.

A first aspect of the combination antenna of the present invention is a combination antenna comprising: a dielectric substrate; a transmission antenna having a plurality of antenna elements vertically arranged on the dielectric substrate in such a manner that a main radiating source is magnetic current and an Eθ component as main polarized waves is placed in a horizontal direction; a receiving antenna having two or more groups of the antenna elements vertically arranged on the dielectric substrate, each of the groups having two antenna elements arranged in the horizontal direction; end-surface EBGs arranged at both end surfaces of the dielectric substrate in the horizontal direction; and a center EBG arranged between the transmission antenna and the receiving antenna, wherein one of the end-surface EBGs, the transmission antenna, the center EBG, the receiving antenna and the other of the end-surface EBGs are arranged in the horizontal direction.

A second aspect of the combination antenna of the present invention is a combination antenna comprising: a dielectric substrate; a transmission antenna having a plurality of antenna elements vertically arranged on the dielectric substrate in such a manner that a main radiating source is magnetic current and an Eθ component as main polarized waves is placed in a horizontal direction; a receiving antenna having two or more groups of the antenna elements vertically arranged on the dielectric substrate, each of the groups having two antenna elements arranged in the horizontal direction; a center EBG arranged between the transmission antenna and the receiving antenna; other EBGs arranged between respective end surfaces of the dielectric substrate in the horizontal direction and the center EBG to be symmetric with respect to the transmission antenna and the receiving antenna; and rims arranged between the respective end surfaces and the other EBGs and between the center EBG and the other EBGs.

A third aspect of the combination antenna of the present invention is a combination antenna comprising: a dielectric substrate; a transmission antenna having a plurality of antenna elements vertically arranged on the dielectric substrate in such a manner that a main radiating source is magnetic current and an Eθ component as main polarized waves is placed in a horizontal direction; a receiving antenna having two or more groups of the antenna elements vertically arranged on the dielectric substrate, each of the groups having two antenna elements arranged in the horizontal direction; end-surface rims arranged at both end surfaces of the dielectric substrate in the horizontal direction; and a center EBG arranged between the transmission antenna and the receiving antenna, wherein one of the end-surface rims, the transmission antenna, the center EBG, the receiving antenna and the other of the end-surface rims are arranged in the horizontal direction.

A fourth aspect of the combination antenna of the present invention is a combination antenna comprising: a dielectric substrate; a transmission antenna having a plurality of antenna elements vertically arranged on the dielectric substrate in such a manner that a main radiating source is magnetic current and an Eθ component as main polarized waves is placed in a horizontal direction; a receiving antenna having two or more groups of the antenna elements vertically arranged on the dielectric substrate, each of the groups having two antenna elements arranged in the horizontal direction; end-surface rims arranged at both end surfaces of the dielectric substrate in the horizontal direction; a center EBG arranged between the transmission antenna and the receiving antenna; another rim arranged between the transmission antenna and the center EBG; and an yet other rim arranged between the receiving antenna and the center EBG, wherein one of the end-surface rims, the transmission antenna, the other rim, the center EBG, the yet other rim, the receiving antenna and the other of the end-surface rims are arranged in the horizontal direction.

Another aspect of the combination antenna of the present invention is characterized in that an RF circuit board is arranged on a surface of the dielectric substrate opposite to the surface where the antenna elements are arranged, in such a manner as to sandwich a ground plane, the other rim and the yet other rim have through holes that pass through the dielectric substrates to be electrically connected to the ground plane, and the through holes pass through the RF circuit board together with another through hole which forms a pole electrically connecting the antenna elements to the ground plane.

Yet another aspect of the combination antenna of the present invention is characterized in that a transmission/reception micro wave integrated circuit (MIC) or an RF circuit is arranged on an RF circuit board corresponding to a back surface of the center EBG.

Yet another aspect of the combination antenna of the present invention is characterized in that a distance between the adjacent rims or EBGs arranged at both sides of the transmission antenna is Asub-1, a distance between the adjacent rims or EBGs arranged at both sides of the receiving antenna is Asub-2, and free space wavelength of radiation wave of the antenna elements is λ0, the Asub-1 meets $0.65<Asub\text{-}1/\lambda 0<0.85$, and the Asub-2 meets $0.95<Asub/\lambda 0<1.3$.

Advantageous Effects of Invention

According to the present invention, it is possible to provide an antenna and a combination antenna having a wide directivity in a plane direction.

DESCRIPTION OF EMBODIMENTS

Figure 1A:
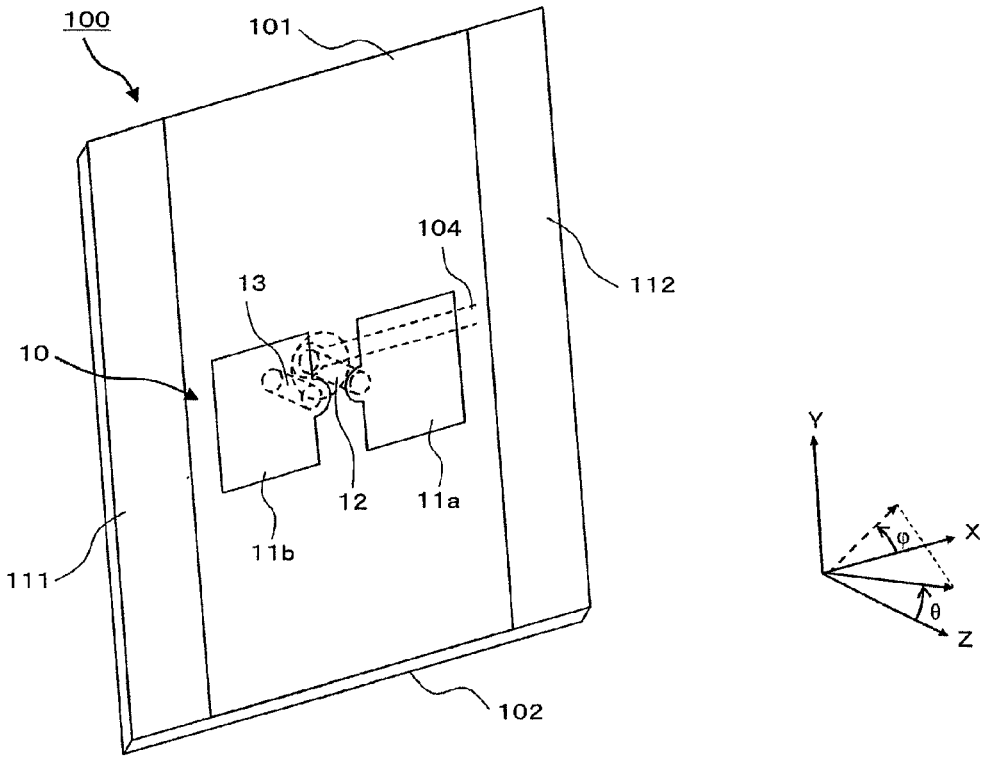
FIGS. 1A to 1C are a perspective view, a plan view and a cross sectional view illustrating the structure of an antenna according to the first embodiment of the present invention.

With reference to the drawings, description is made about an antenna and a combination antenna according to a preferred embodiment of the present invention. Elements having the same functions are denoted by the same reference numerals for simple explanation and illustration.

First description is made about an antenna element used in the antenna and combination antenna of the present invention and a monopulse antenna formed of two antenna elements arranged. The monopulse antenna has a minimum necessary configuration to realize a measurement function of azimuthal angles.

Figure 2A:
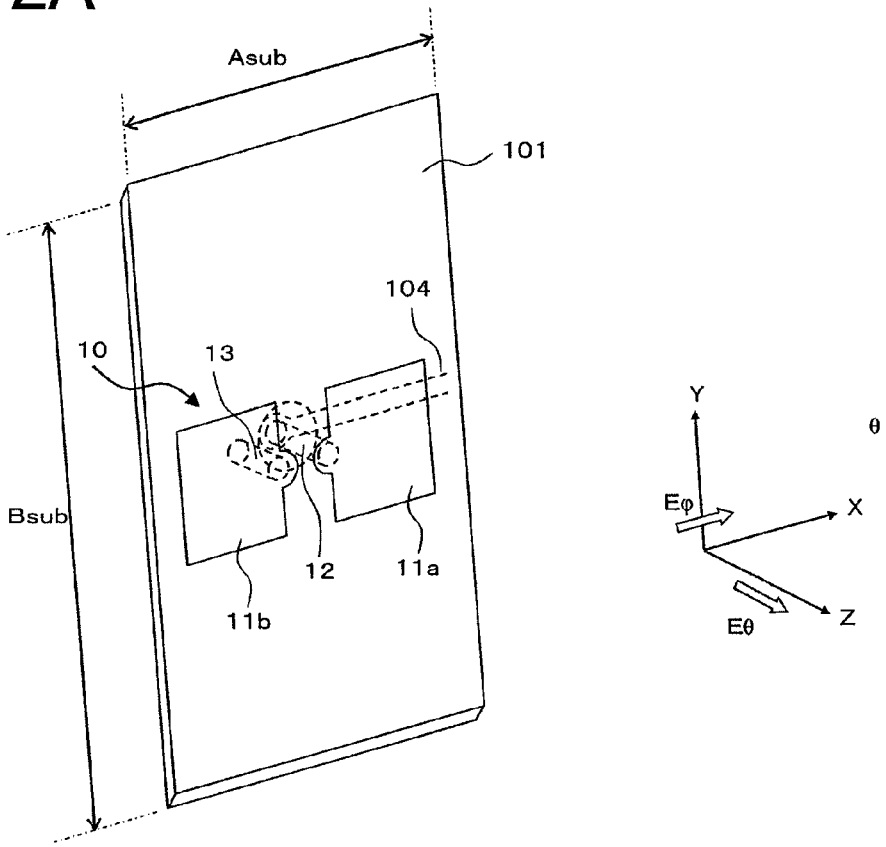
FIGS. 2A to 2C are a perspective view, a plan view and a cross sectional view illustrating a conventional antenna structure.
Figure 2B:
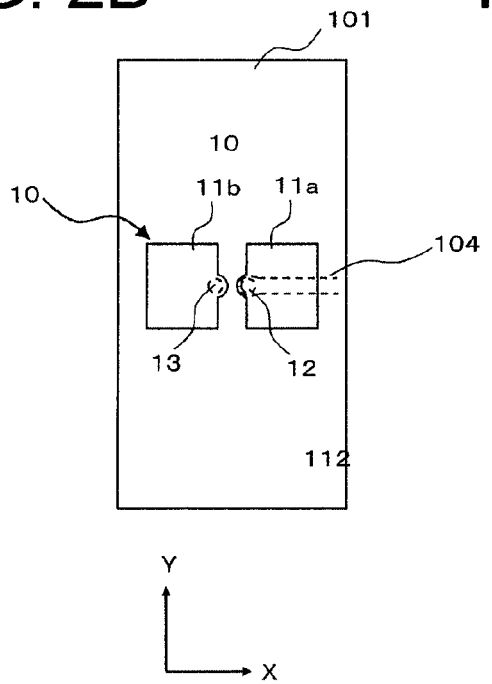
Figure 2C:
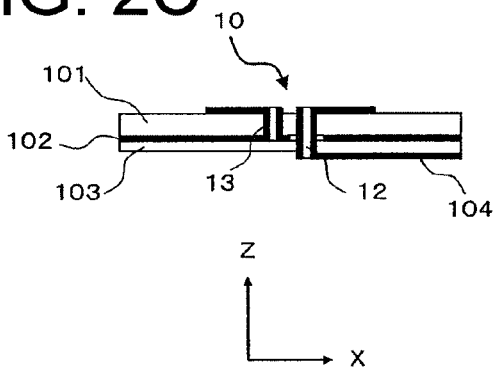

FIGS. 2A to 2C illustrate an example of a conventional antenna having antenna elements used in an antenna or the like of the present invention. FIGS. 2A to 2C are views each illustrating a structure of the conventional antenna having the antenna elements 10. FIGS. 2A, 2B and 2C are a perspective view, a plan view and a cross sectional view, respectively, of the conventional antenna. The antenna element 10 has a radiating element 11 composed of a first element 11*a* and a second element 11*b*, a first pole (through hole) 12 and a second pole (through hole) 13. They are arranged on one surface of a dielectric substrate 101 into a printed dipole antenna. On the other surface of the dielectric substrate 101, a ground plane 102 is provided. Besides, another dielectric substrate 103 is provided in such a manner as to sandwich the ground plane 102, and a transmission line 104 is provided on the opposite surface of the dielectric substrate 103 to the ground plane 102. The first element 11*a* is connected to the transmission line 104 via the first pole (through hole) 12 for feed and the second element 11*b* is connected to the ground plane 102 via the second pole (through hole) 13.

In the following, for simple explanation, a coordinate system illustrated in FIGS. 2A to 2C is used. Here, two directions that are in parallel to the dielectric substrate 101 and the ground plane 102 and orthogonal to each other are X and Y directions. The direction orthogonal to the dielectric substrate 101 and the ground plane 102 is Z direction. The first element 11*a* and the second element 11*b* are arranged so that the Eθ component of the transmission waves or reception waves is placed on the X-Z plane. When the antenna element 10 is used in the in-vehicle radar, the X-Z plane is the horizontal plane and the Y-Z plane is the vertical plane. Besides, the length in the X direction of the dielectric substrate 101 (width) is Asub and the length in the Y direction is Bsub.

The antenna element 10 is formed into the printed dipole antenna and the coordinate system shown in FIGS. 2A to 2C is of the printed dipole antenna. Here, when the ground plane 102 is an infinite one, the reason why the Eθ component of the antenna element 10 as the printed dipole antenna is wide is explained below. When the free space wavelength of the transmission waves and reception waves is λ0 and the value a of the width 2a of the antenna element 10 in the X direction is selected to meet 2a≠λ0/2, magnetic current Im flows as a radiating source in the same direction in the first element 11*a* and the second element 11*b* as shown by the arrow D1 corresponding to the electric field E1 shown in FIG. 3 by feeding from the first pole 12 approximately at the center of the antenna element 10 to the antenna element 10.

Figure 3:
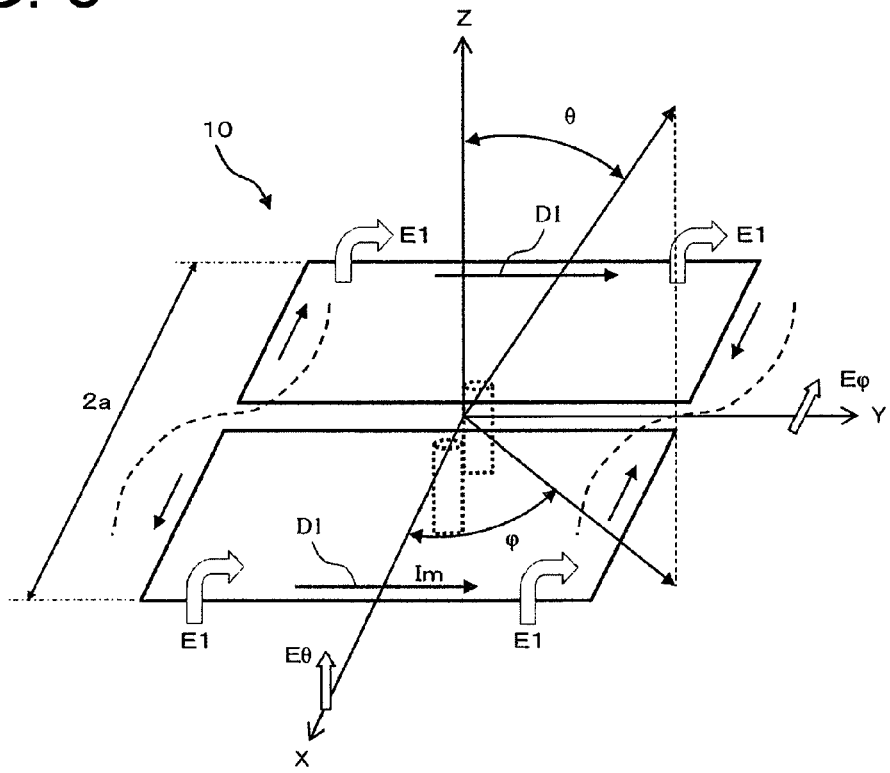
FIG. 3 is an explanatory view illustrating magnetic current of a printed dipole antenna.

In FIG. 3, as the Eθ component is a component of ϕ=0 degree, the magnetic current Im is always shown like a line even when θ is scanned at −90 to +90 degrees. On the other hand, as the Eϕ component is of ϕ=90 degrees, when θ is scanned at −90 to +90 degrees, the magnetic current Im is changed from the line to dots and is applied with cos θ in the directivity and accordingly, the directivity becomes narrow. However, when the ground plane 102 is the finite plate, the difference in directivity tends to be small.

Figure 4:
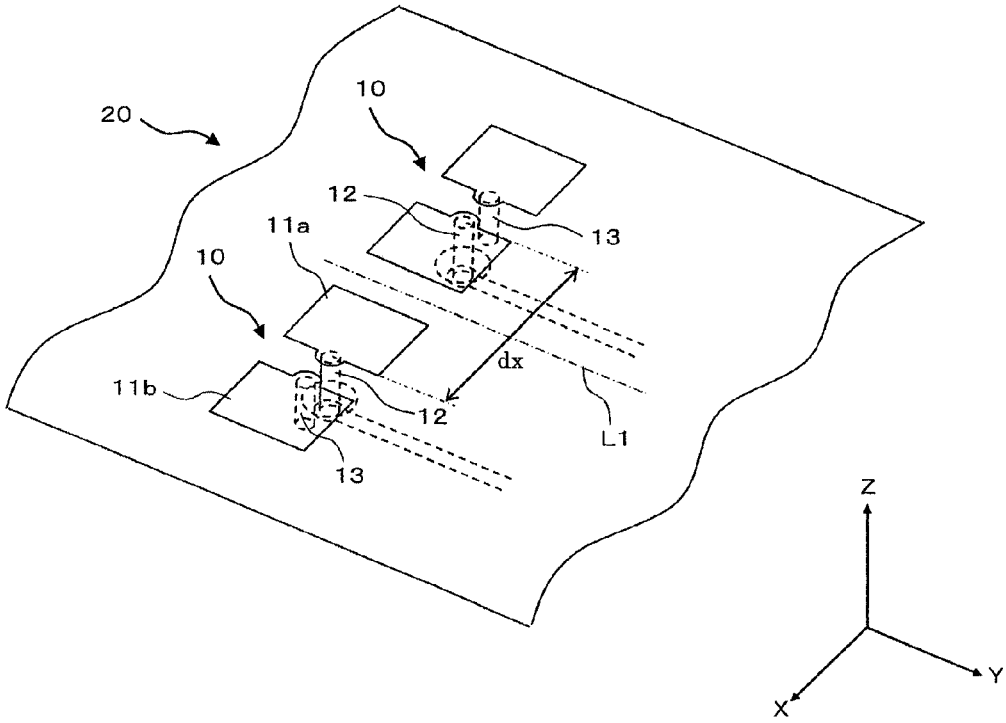
FIG. 4 is a perspective view illustrating the structure of a monopulse antenna.
Figure 5A:
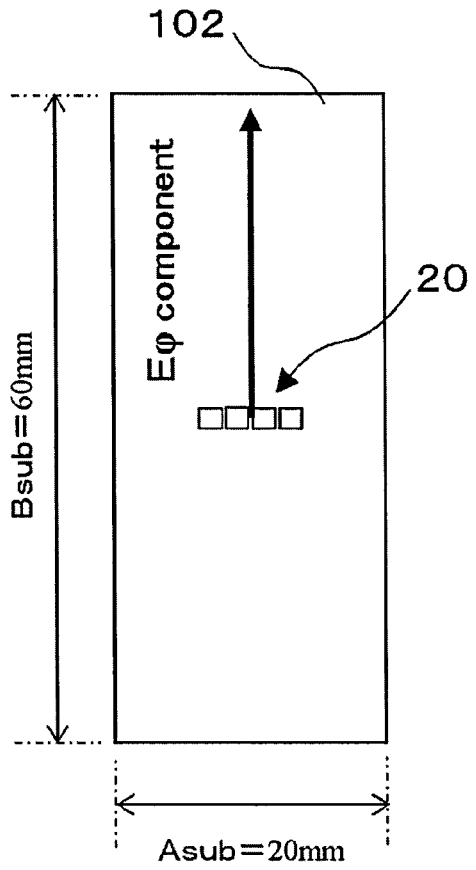
FIGS. 5A to 5C are explanatory views for illustrating comparison by simulation analysis of Eϕ and Eθ components of the monopulse antenna.
Figure 5B:
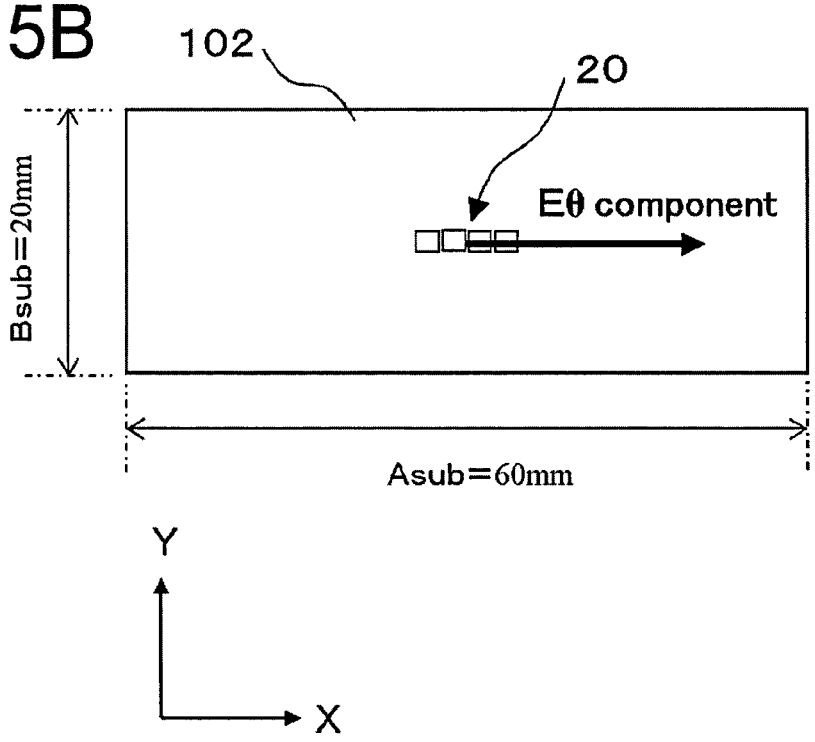

Comparison of amplitude distribution of Eθ and Eϕ components in the finite ground plane is performed with use of the monopulse antenna 20 in which antenna elements 10 shown in FIG. 4 are arranged two in the X direction in such a manner as to keep the Eθ component horizontal. The monopulse antenna 20 is such that, as illustrated in FIGS. 5A and 5B, on the dielectric substrate 101 with the length in the X direction (width) Asub and the length in the Y direction Bsub, the radiating elements 11 (11*a* and 11*b*) are arranged symmetrical with respect to the center axis L1 in such a manner as to achieve horizontally symmetric electric wave properties with respect to the center of the two antenna elements 10 (in the X direction) and the radiating elements 11 are supplied with opposite-phase power in order to show excellent monopulse difference pattern symmetric properties. In FIG. 4, dx indicates the distance between feed points of the two antenna elements 10. In the following description, this antenna is called an reverse phase feed monopulse antenna.

With use of the monopulse antenna element 20 shown in FIG. 4, simulation analysis is performed on the Eθ and Eϕ components when the ground plane 102 is the finite plate, which is illustrated in FIGS. 5A and 5B. In the simulation of the Eϕ component, it is assumed that the dimension Bsub of the ground plane 102 in the direction of the Eϕ component is 60 mm and the dimension Asub of the ground plane 102 orthogonal to the direction of Bsub is 20 mm (see FIG. 5A). In addition, in the simulation of the Eθ component, it is assumed that the dimension Asub of the ground plane 102 in the direction of the Eθ component is 60 mm and the dimension Bsub of the ground plane 102 orthogonal to the direction of Asub is 20 mm (see FIG. 5B). In FIGS. 5A and 5B, the dielectric substrate 101 is omitted.

Figure 5C:
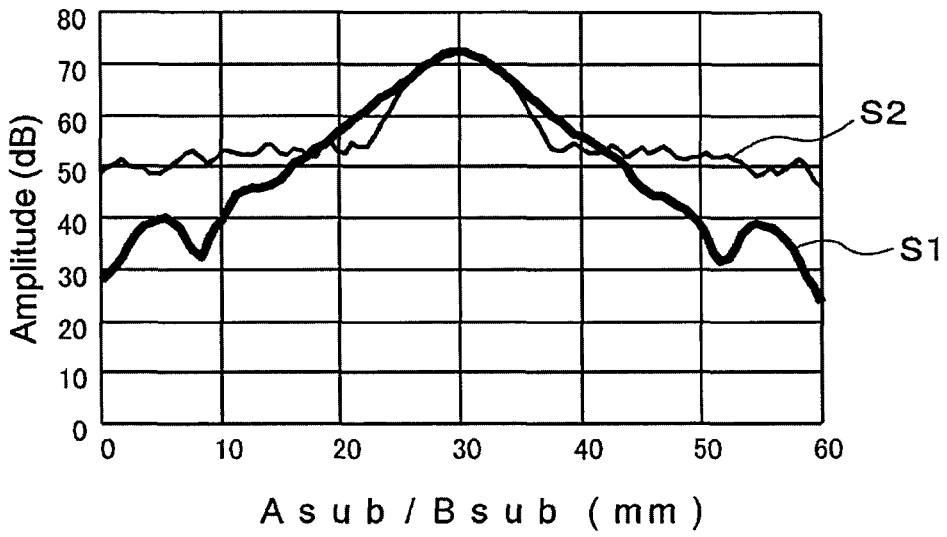

In comparison of the Eϕ component (represented by S1) and the Eθ component (represented by S2) in FIG. 5C, the Eϕ component S1 is lowered about −43 dB at both ends as compared with the value at the center of the ground plane 102 and the Eθ component S2 is lowered only about −23 dB, which shows existence of considerably great electric field at both ends of the ground plane 102. This is a cause for ripples that occur in the radiation pattern by action as the TM mode surface wave.

Figure 6A:
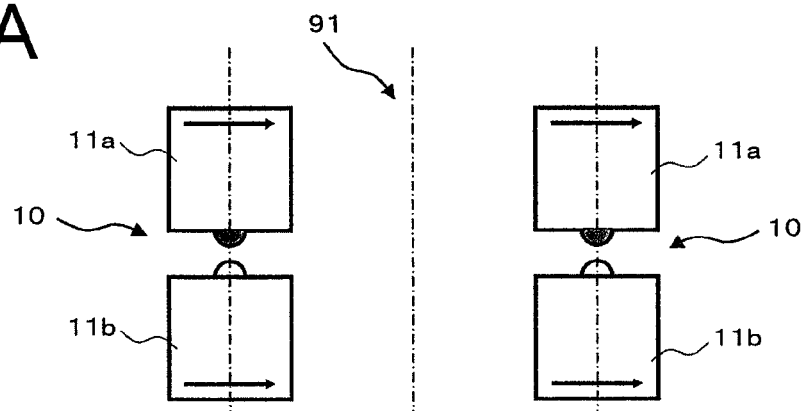
FIGS. 6A to 6C are explanatory views for illustrating three structural examples of the monopulse antenna.
Figure 6B:
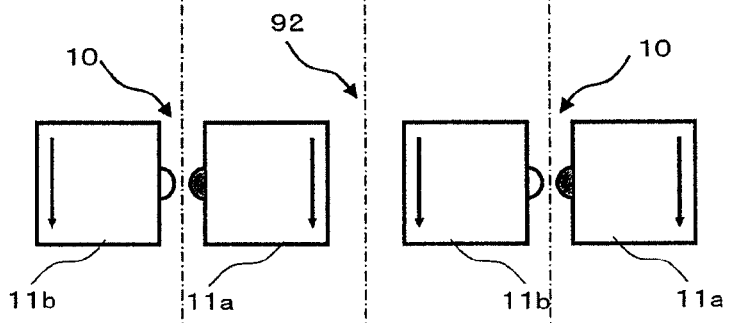
Figure 6C:
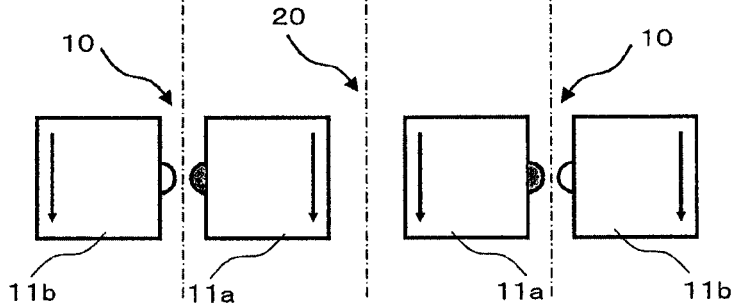
Figure 6C:
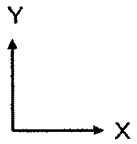
Figure 30A:
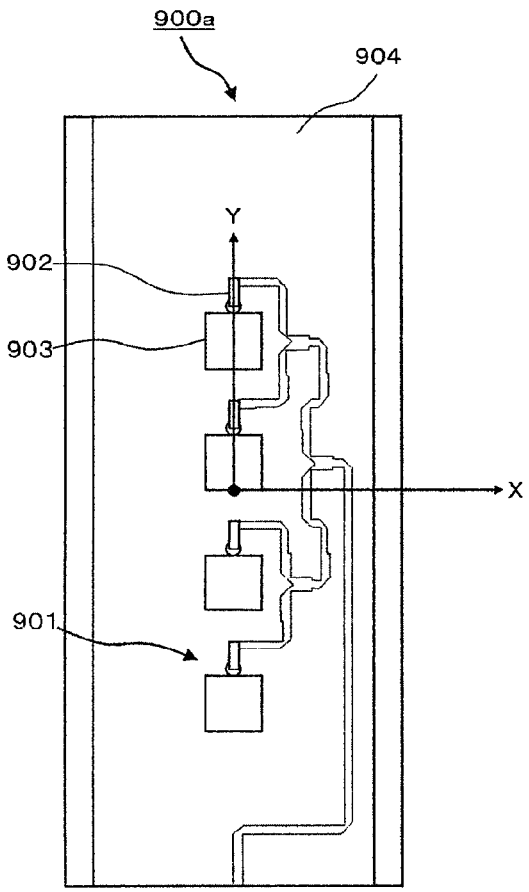
FIGS. 30A and 30B are perspective views each illustrating the structure of a conventional array antenna for UWB radar.
Figure 30B:
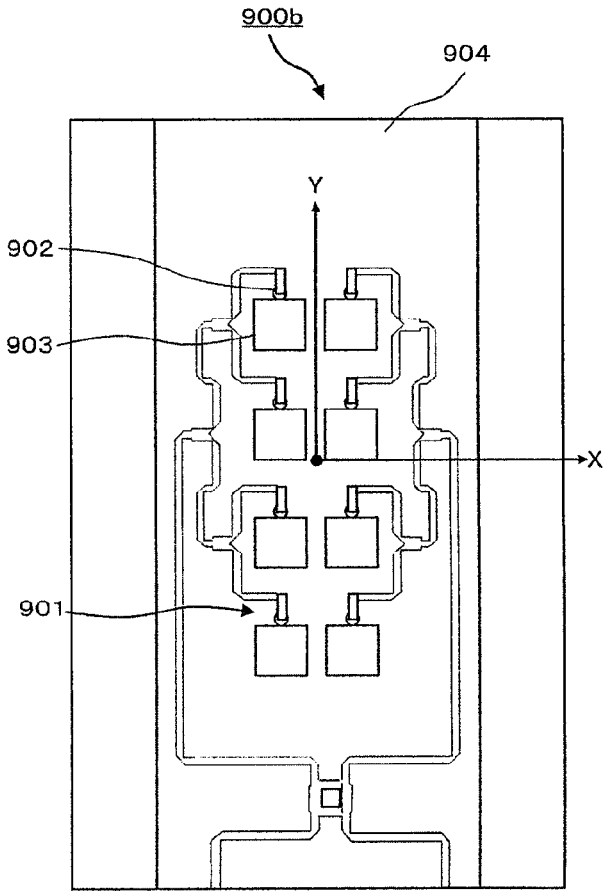

Next description is made about suitable combination of two antenna elements 10 in the configuration of the monopulse antenna. FIGS. 6A to 6C illustrate three different configurations of the monopulse antenna. FIG. 6A illustrates the configuration of the two antenna elements 10 as vertical polarized wave like in the conventional antenna 900 shown in FIG. 30, and FIGS. 6B and 6C illustrates the configuration of the two antenna elements 10 as horizontal polarized wave. In FIGS. 6B and 6C, the feed methods are different from each other.

In the monopulse antenna 91 of the conventional structure shown in FIG. 6A, as the antenna elements 10 are arranged as vertical polarized wave, the Eϕ component is horizontal. That is, as the Eϕ component of narrow beam width is arranged in the horizontal direction, the measurable angular range becomes narrower.

In the monopulse antenna 92 shown in FIG. 6B, as the antenna elements are arranged as horizontal polarized wave, the Eθ component is horizontal. And, as the phase comparison monopulse system, the two antenna elements 10 are fed in phase. As the monopulse antenna 92 is arranged with the Eθ component horizontal, the Az sum pattern shows wide range property, but there is a problem in horizontal symmetric property (X direction) and it is difficult to realize the monopulse difference pattern of excellent symmetric form.

On the other hand, in the monopulse antenna 20 shown in FIG. 6C, the antenna elements 10 are arranged as horizontal polarized wave and as the phase comparison monopulse system, the two antenna elements 10 are reverse phase fed. As the monopulse antenna 20 is arranged with the Eθ component horizontal, the Az sum pattern shows excellent wide-range property and it is possible to realize a monopulse difference pattern of excellent horizontally (X-directional) symmetric and smooth form.

Figure 7A:
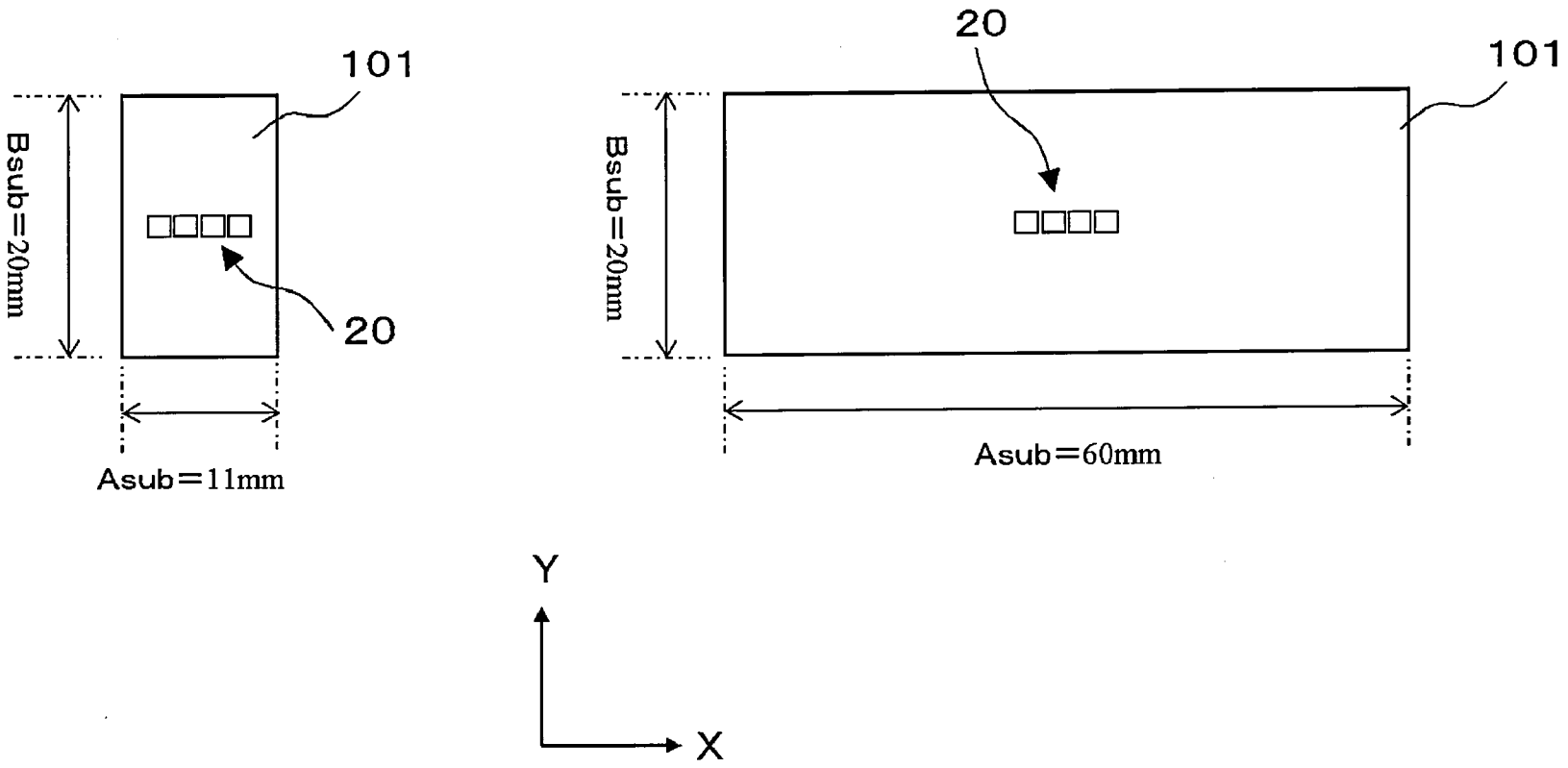
FIGS. 7A and 7B are explanatory views showing simulation analysis results of sum patterns of the monopulse antenna when the width of the dielectric substrate varies.

The relation between the shape of the radiation beam of the monopulse antenna 20 and the length in the X direction (horizontal direction) of the dielectric substrate 101 (width Asub) is described with reference to FIGS. 7A and 7B below, which illustrate simulation results when the width Asub of the dielectric substrate 101 varies. When the width Asub of the dielectric substrate 101 is changed like Asub=11 mm (S11), 20 mm (S12), 40 mm (S13) and 60 mm (S14) as illustrated in FIG. 7A, the sum pattern of the amplitude Az of the monopulse antenna 20 varies, which is illustrated in FIG. 7B.

Figure 7B:
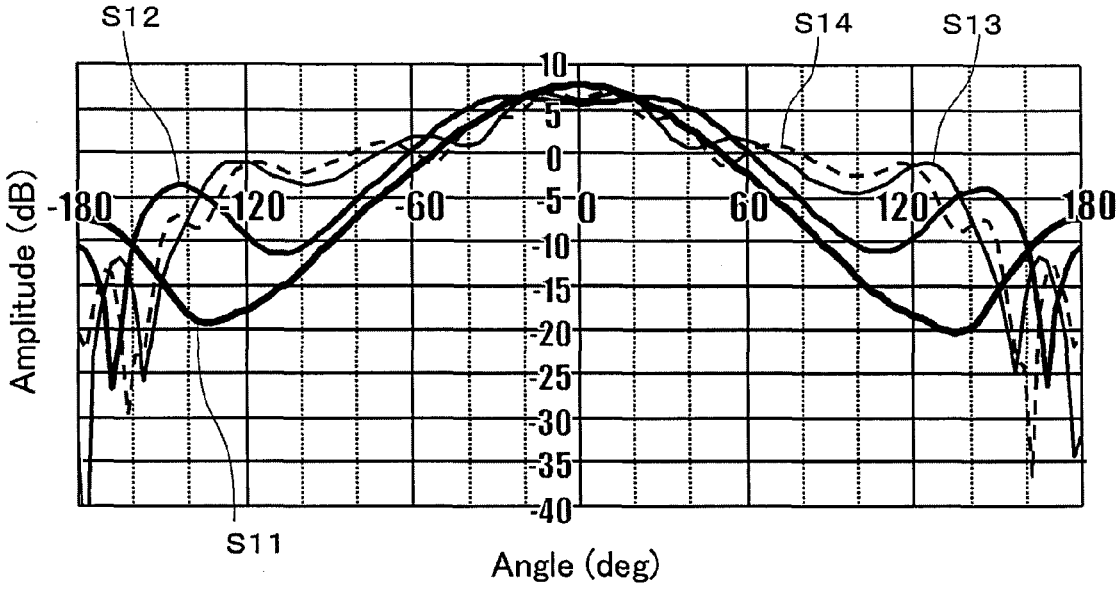

As illustrated in FIG. 7B, when the width Asub of the dielectric substrate 101 is changed, the monopulse sum patter of the amplitude Az in the Z direction varies. Particularly, as the width Asub increases, the TM surface wave overlaps the sum pattern and there occur ripples. In the analysis results shown in FIG. 7B, when the width Asub is about 20 mm (code S12), the obtained sum pattern shows a relatively excellent symmetric and smooth property over a wide range.

As described above, when the magnetic current element like the printed dipole antenna is used and is arranged in the horizontal direction so that its Eθ component becomes main polarized wave, the sum pattern of the amplitude Az shows a wide-range property. In addition, as the width Asub of the dielectric substrate 101 is about 20 mm, the sum pattern has excellent relatively symmetric and smooth properties over a wide range. However, when the width Asub is changed from 20 mm, this monopulse sumpattern is also changed.

Figure 1B:
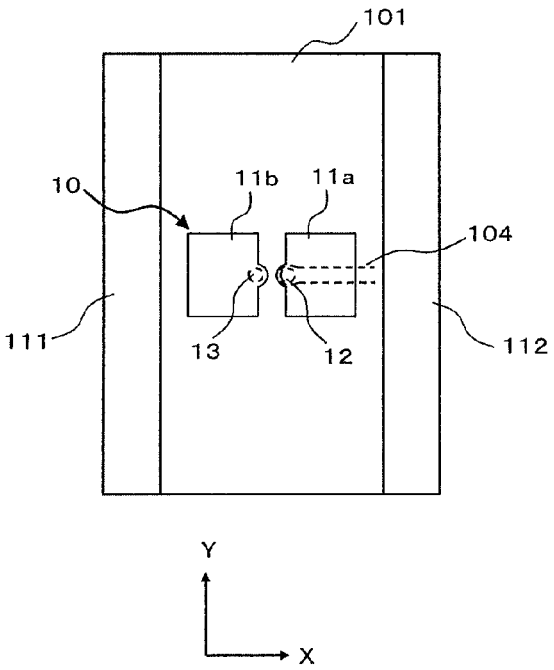
Figure 1C:
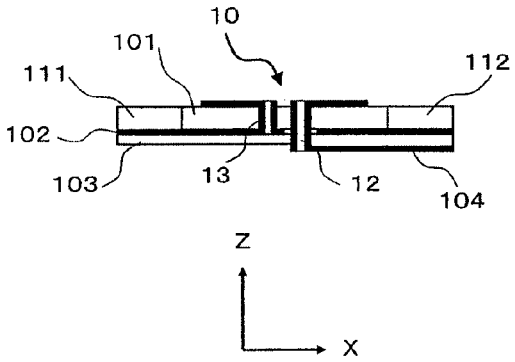

Then, in the antenna and combination antenna of the present invention, for the purpose of suppressing of TM surface wave on the dielectric substrate 101 and shaping of the radiation pattern, a rim made of a metal plate or EBG (Electromagnetic Band Gap) is arranged near the antenna element 10 arranged in the X direction (horizontal direction). EBG has two types of coplanarity type and mushroom type, either of which is selected to be used according to the situation. In the combination antenna of the present invention, whichever EBG is used, the same function is obtained. Therefore, these are not distinguished in the following description. First, the antenna according to the first embodiment of the present invention is described with reference to FIG. 1. FIGS. 1A to 1C are views each illustrating the structure of the antenna 100 of the present embodiment. FIGS. 1A to 1C are a perspective view, a plan view and a cross sectional view of the antenna 100.

The antenna 100 of the present embodiment shown in FIGS. 1A to 1C is configured to have an antenna element 10 and rims 111, 112 arranged at both X-directional ends of the dielectric substrate 101 in such a manner as to sandwich the antenna element 10. The antenna element 10 has the radiating element 11 composed of the two elements, which are the first element 11*a* and the second element 11*b*, the first pole 12 and the second pole 13. The antenna element 10 is arranged on one surface of the dielectric substrate 101 to be a printed dipole antenna. On the other surface of the dielectric substrate 101, the ground plane 102 is provided. Further, another dielectric substrate 103 is provided in such a manner as to sandwich the ground plane 102, and the transmission line 104 is provided on the surface of the dielectric substrate 103 opposite to the ground plane 102. The first element 11*a* is connected to the transmission line 104 via the first pole (through hole) 12 and fed and the second element 11*b* is connected to the ground plane 102 via the second pole (through hole) 13.

The rims 111, 112 are arranged symmetric or asymmetric in the X direction with respect to the antenna element 10. The rims 111, 112 are made of metal plates or EBG. In this way, as the rims 111, 112 are provided at the both sides in such a manner as to sandwich the antenna element 10, it is possible to reduce the width of the dielectric substrate 101 of the antenna 100, which is required to realize the wide coverage. As a result, it is possible to increase the space for integration of other RF circuits, thereby improving the space factor.

Figure 8B:
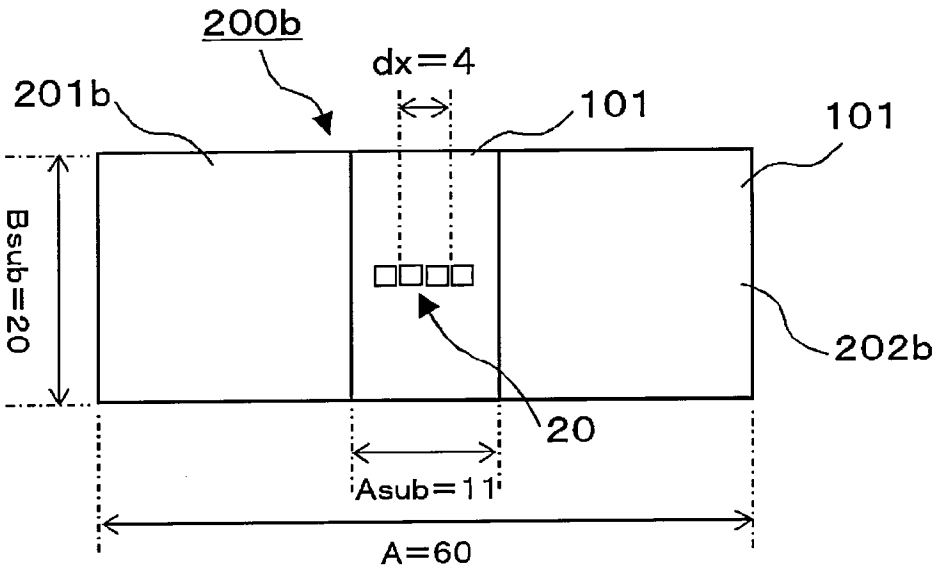
FIGS. 8A and 8B are plan views illustrating the structure of an antenna according to the second embodiment of the present invention.
Figure 8A:
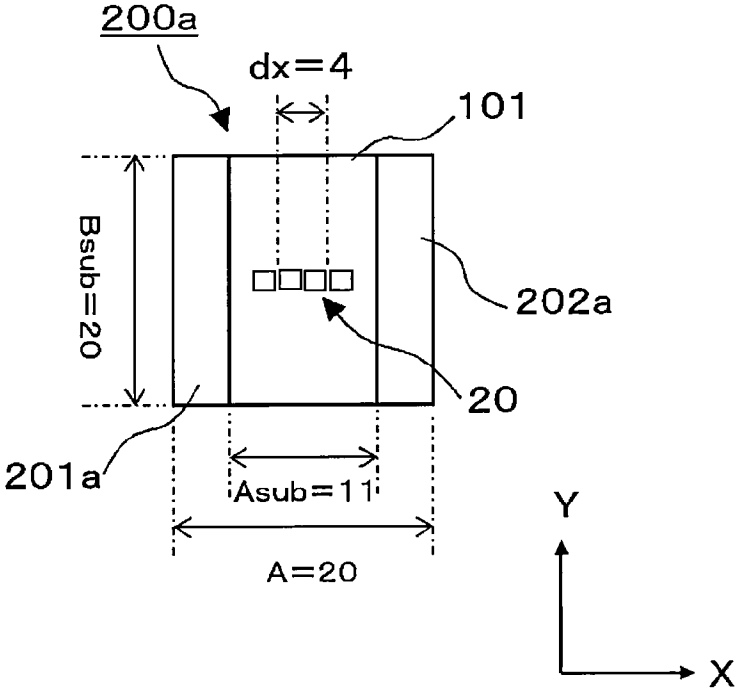

Next description is made, with reference to FIGS. 8A and 8B, about an antenna according to the second embodiment of the present invention. FIGS. 8A and 8B are plan views illustrating the structures of antennas 200*a* and 200*b* of this embodiment. The antenna 200*a* of this embodiment shown in FIG. 8A is an array antenna composed of a phase-comparison monopulse antenna 20 having two antenna elements arranged in a 1×2 pattern, and the array antenna is sandwiched by rims 201*a* and 202*a* at both ends in the X direction of the dielectric substrate 101. In addition, FIG. 8B illustrates the antenna 200*b* which is the monopulse antenna 20 of the same size provided with rims 201*b* and 202*b* of different size.

In the antenna 200*a* shown in FIG. 8A, the width Asub of the dielectric substrate 101 (length in the X direction) is 11 mm, the widths of the rims 201*a*, 202*a* arranged left and right are both 4.5 mm, and the total width A becomes 20 mm. In addition, in the antenna 200*b* shown in FIG. 8B, the width Asub of the dielectric substrate 101 is also 11 mm, the widths of the rims 201*b*, 202*b* arranged left and right are both 24.5 mm, and the total width A becomes 60 mm. The length Bsub in the Y direction is 20 mm in both antennas 200*a*, 200*b*.

Figure 9A:
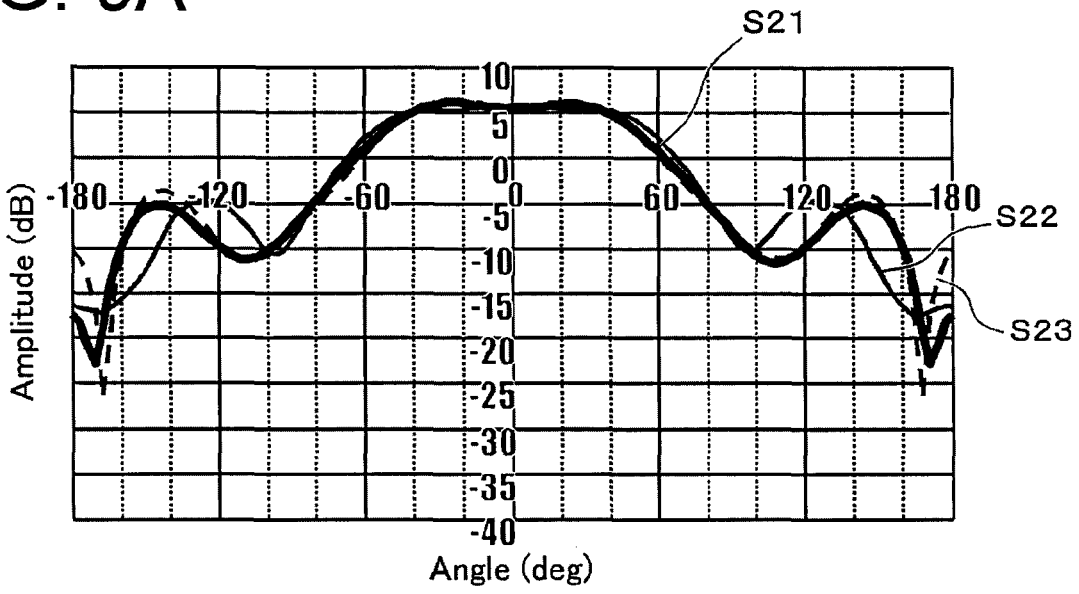
FIGS. 9A and 9B are explanatory views illustrating one example of simulation analysis of the monopulse sum patterns of the antenna according to the second embodiment.
Figure 9B:
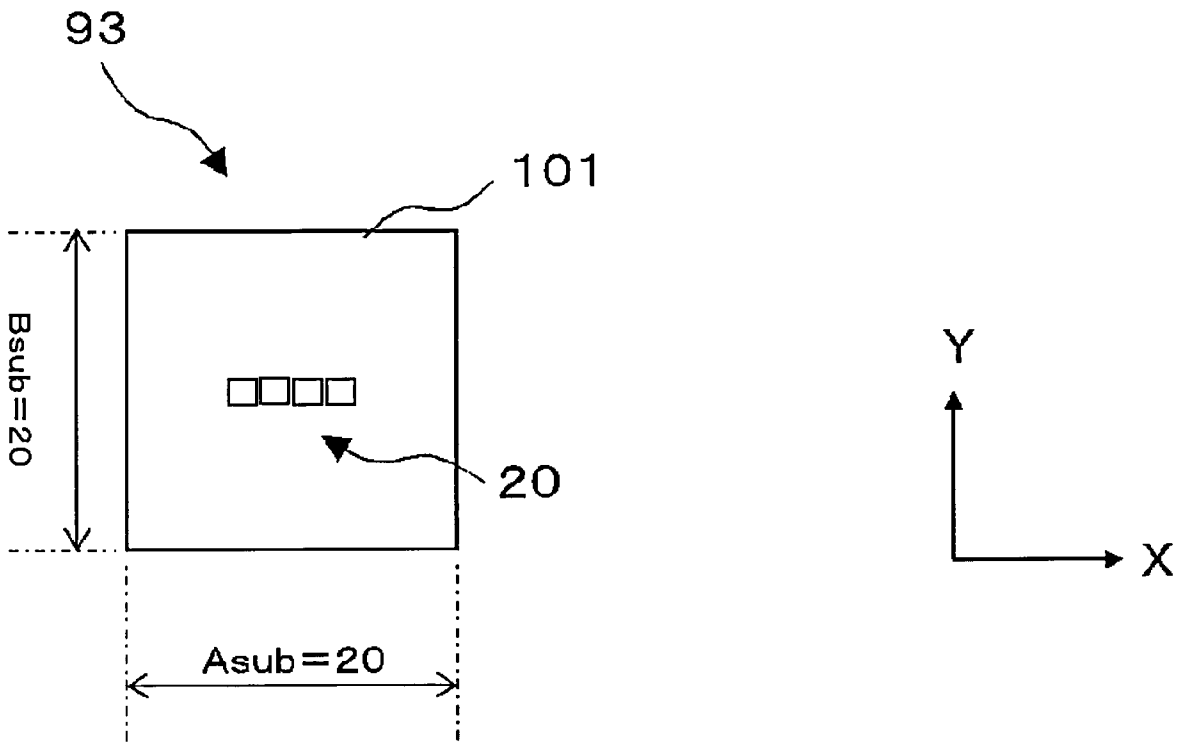

An example of simulation analysis of phase comparison monopulse sum patterns of the antennas 200*a*, 200*b* (indicated by S21, S22, respectively) is shown in FIG. 9A. In addition, for comparison, a result of simulation analysis of the antenna 93 (B=20 mm) shown in FIG. 9B in which the width Asub of the dielectric substrate 101 is 20 mm and no rim is provided is also shown in FIG. 9A (indicated by S23). As illustrated in FIG. 9A, the monopulse sum patterns S21, S22 of the antennas 200*a*, 200*b* of this embodiment in which the widths Asub of the dielectric substrates 101 are both 11 mm have approximately equal properties as compared with the monopulse sum pattern S23 of the antenna 93 in which the width Asub is 20 mm. Besides, as shown in the analysis result of the antenna 200*b*, there is little change in the sum pattern even when the widths of the rims 201*b*, 202*b* are changed to elongate the total width A of the antenna 200*b* up to 60 mm.

According to the antennas 200*a*, 200*b* of this embodiment, as the rims 201*a*, 202*a* and the rims 201*b*, 202*b* are arranged at both sides of the monopulse antenna 20, it is possible to drastically reduce the width Asub of the dielectric substrate 101, which is required to realize the wide-coverage sum pattern, from 20 mm to 11 mm by about 55%. Consequently, it is possible to improve the space factor greatly when other RF circuit elements are integrated at the surfaces or back surfaces of the antennas 200*a*, 200*b*.

As described above, as the rims 201*a*, 202*a* and 201*b*, 202*b* are provided, it is possible to reduce the width Asub of the dielectric substrate 101 required to realize a wide band and also to improve a space factor for integration of another RF parts. In addition, as described later, it is possible to electrically separate the antenna area from the RF area inevitably and to enhance isolation between the two areas thereby to bring about an effect of preventing unnecessary interference.

Figure 10:
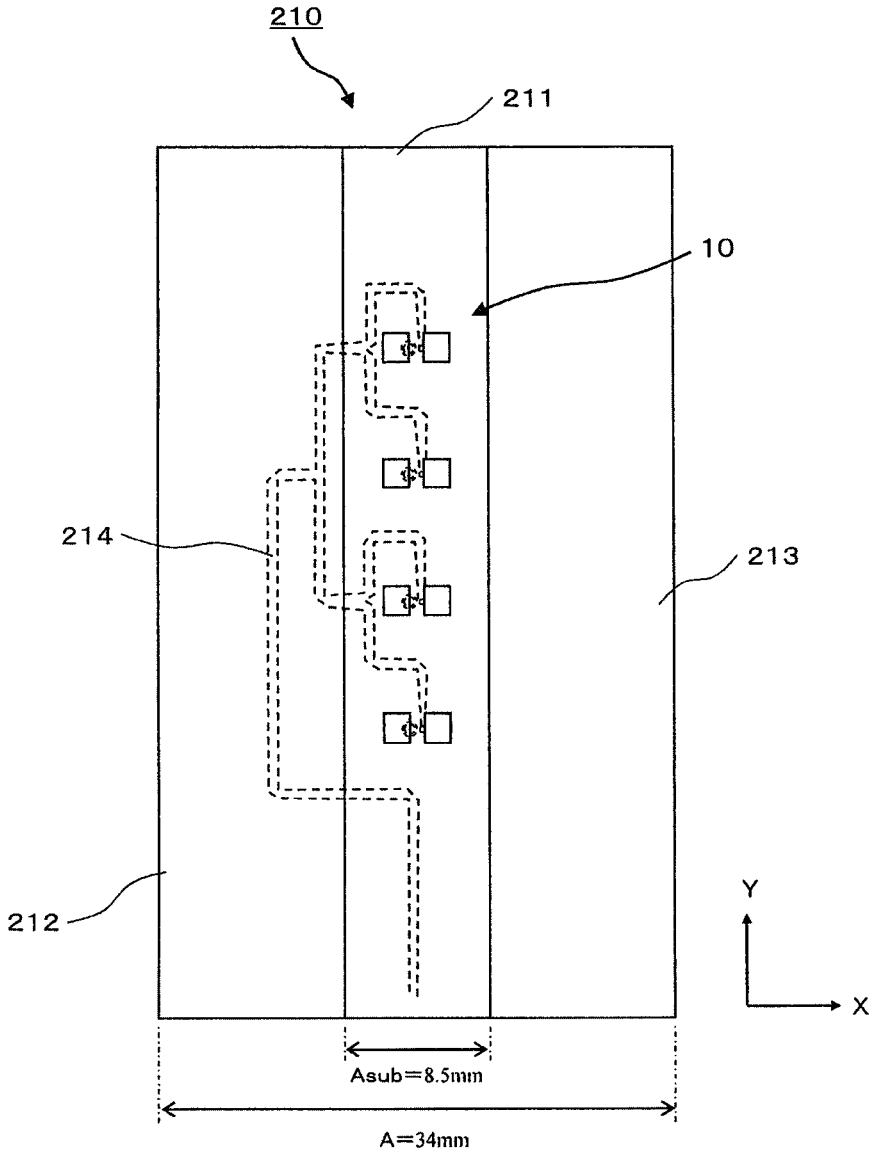
FIG. 10 is a plan view illustrating the structure of an antenna according to the third embodiment of the present invention.

An antenna according to the third embodiment of the present invention will be described with reference to FIG. 10. FIG. 10 is a plan view illustrating the structure of the antenna 210 of the present embodiment. The antenna 210 of the present embodiment is structured as a linear array antenna in which four antenna elements 10 are arranged on a dielectric substrate 211 in a line (4×1 pattern). At its left and right sides (X direction), rims 212 and 213 are provided. The width Asub of the dielectric substrate 211 is 8.5 mm and the total width A including the rims 212, 213 is 34 mm. The reference numeral 214 denotes a transmission line which is formed on the back surface of the antenna 210 to be connected to each of the antenna elements 10. The antenna 210 is used as a transmission antenna for a radar device.

Figure 11A:
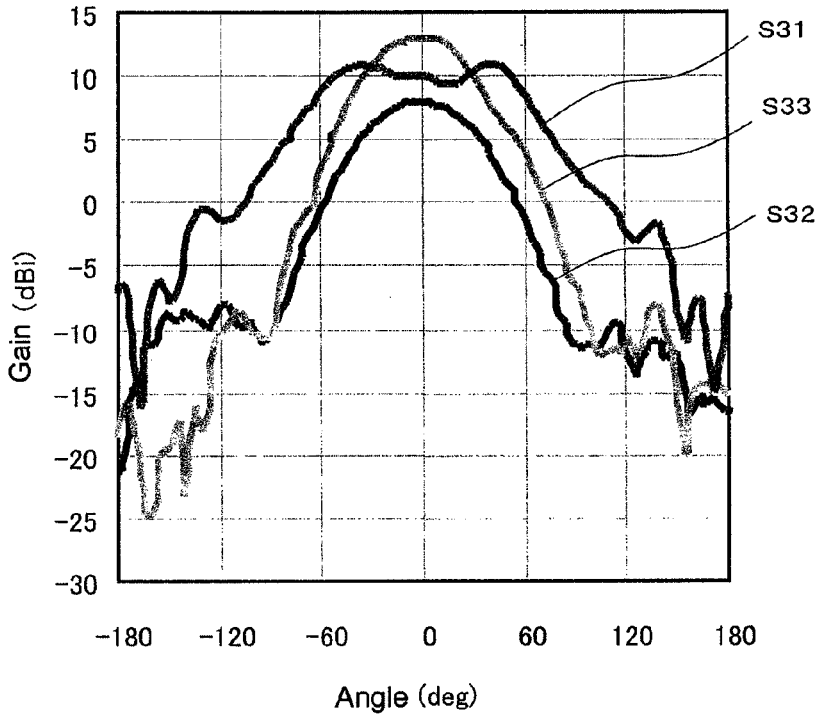
FIGS. 11A and 11B are graphs showing simulation analysis results of radiation pattern of the antenna according to the third embodiment.
Figure 11B:
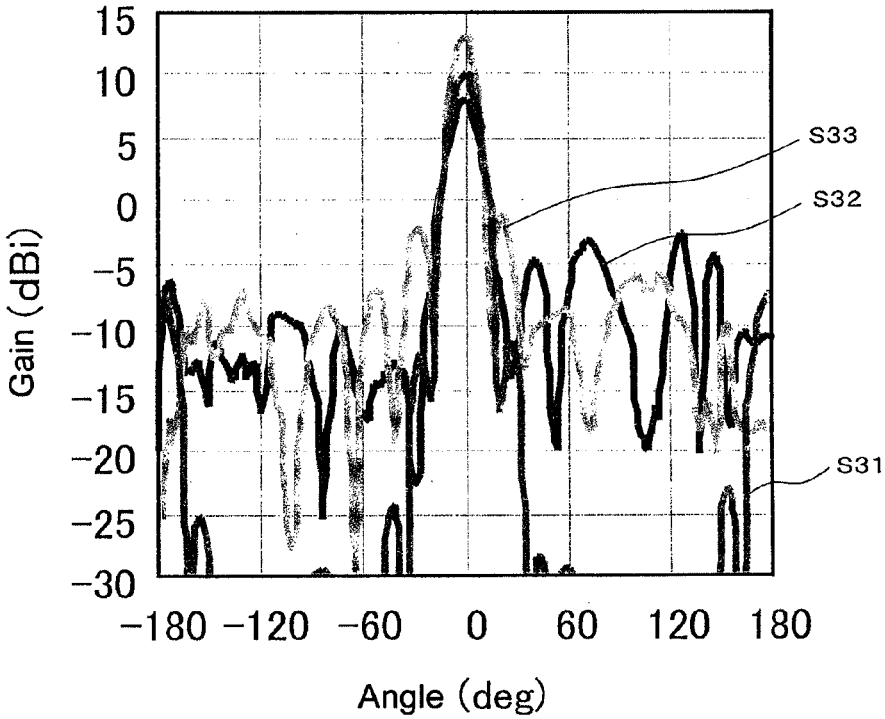
Figure 31:
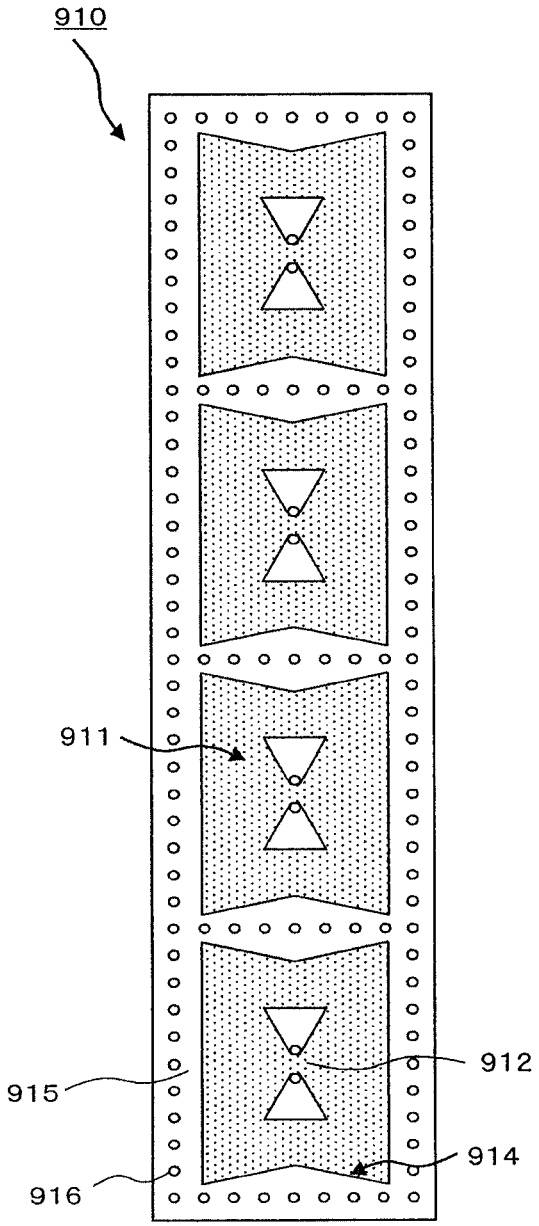
FIG. 31 is a plan view illustrating the structure of another conventional array antenna for UWB radar.

As to the radiation pattern of the linear array antenna 210 of the present embodiment, its simulation analysis results are shown in FIGS. 11A and 11B by S31. FIG. 11A shows Az patterns of the Eθ component as radiation pattern in the horizontal direction (XZ direction) and FIG. 11B shows EL patterns of the Eθ component as radiation pattern in the vertical direction (YZ direction). In FIGS. 11A and 11B, analysis results (S32, S33) of the radiation patterns of the conventional linear array antenna 900*a* shown in FIG. 30A and the conventional linear array antenna 910 shown in FIG. 31 are also shown for comparison.

In the Az pattern shown in FIG. 11A, the coverage in the horizontal direction of the linear array antenna 210 of the present embodiment is clearly wider than those of the conventional linear array antennas 900*a*, 910. Specifically, decreases in gain at ±60 degrees are −8 dB for the conventional linear array antenna 900*a* and −13 dB for the conventional linear array antenna 910, while in the linear array antenna 210 of the present embodiment, the decrease is only about −3 dB, which shows realization of the radiation pattern of a wider coverage.

Figure 12:
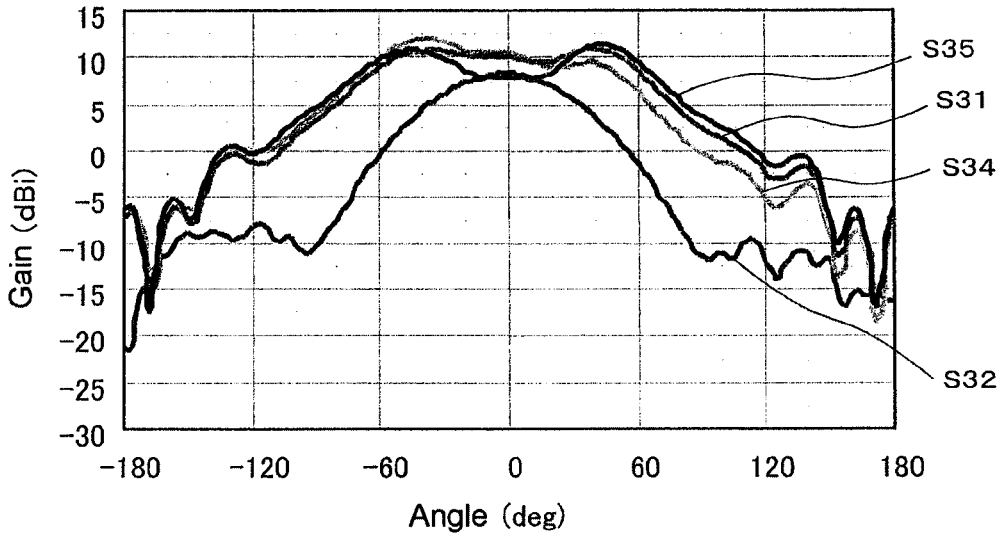
FIG. 12 is a graphs showing simulation analysis results of radiation patterns when the width of the dielectric substrate of the antenna of the third embodiment varies.

Next description is made about an effect on the Az pattern by the width size Asub of the dielectric substrate 101 in the linear array antenna 210 of the present embodiment, with reference to the simulation results of the Az pattern illustrated in FIG. 12. Here, the Az pattern is shown at the frequency of 26.5 GHz, while setting the width size Asub at 7 mm (S34), 10 mm (S35) in addition to 8.5 (S31) shown in FIG. 10. Besides, the Az pattern (S32) of the conventional linear array antenna 900*a* is also shown. As seen from FIG. 12, when the width size is 7 mm, (S34) shows a pattern which lowers to the right and is low in symmetric property, while (S35) of the width size A of 10 mm shows a pattern which is diphasic and high in symmetric property. Here, shown are the radiation patterns at the frequency of 26.5 GHz, however, when the frequency increases to 28 GHz, more ripples appear.

As seen from the results of FIG. 12, the range of the width size Asub of the dielectric substrate 211 permissible from the Az pattern shape is given by (1).

$$7.5\ \text{mm} < A\text{sub} < 9.5 \quad \text{mm} \quad (1)$$

When the frequency is 26.5 GHz, the free space wavelength λ0 becomes 11.312 mm. The above-mentioned expression is normalized by the wavelength λ0, the following expression can be obtained.

$$0.65 < A\text{sub}/\lambda 0 < 0.85 \quad (2)$$

The width size A of the dielectric substrate 211 is preferably set to fall within the above-mentioned range.

Figure 13:
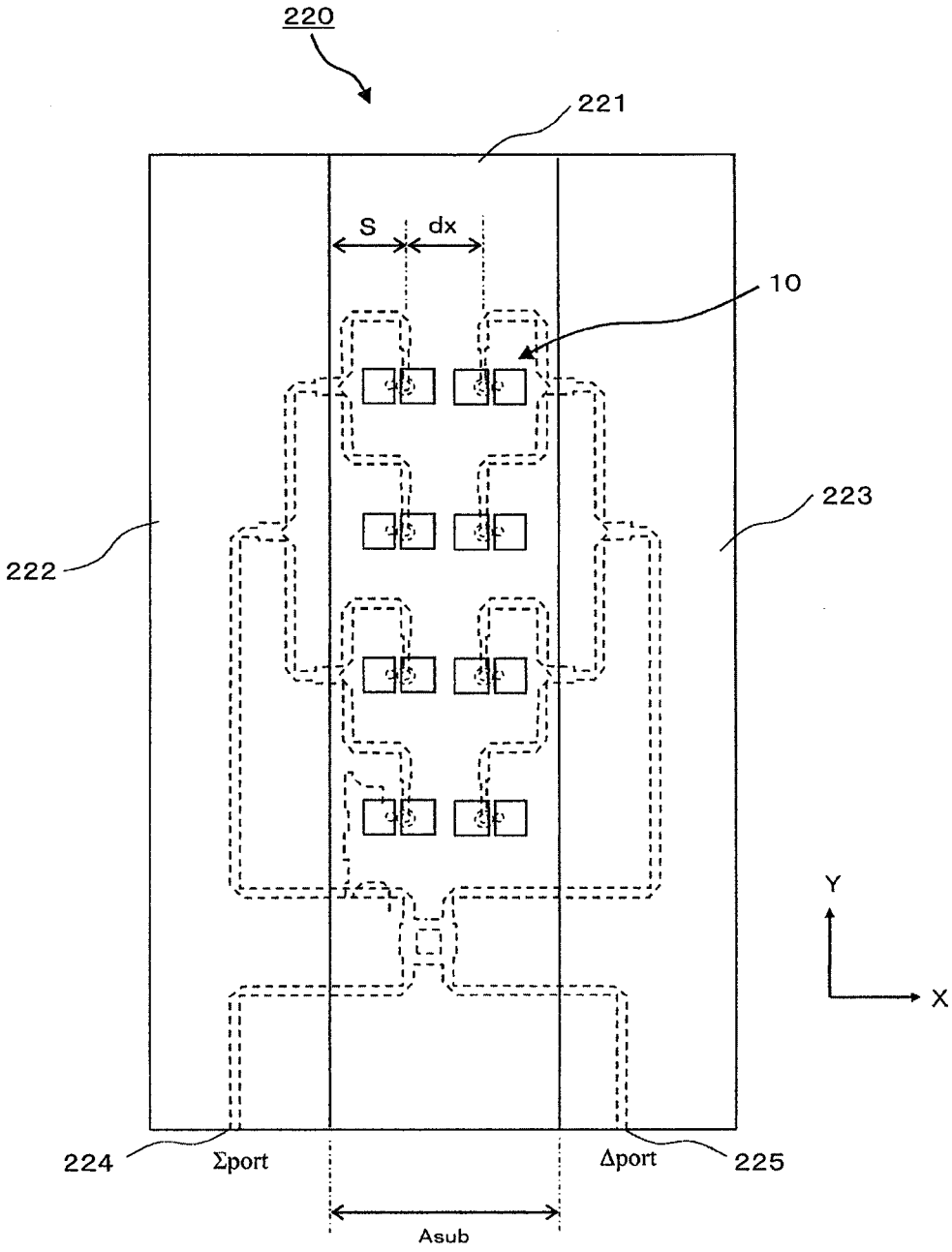
FIG. 13 is a plan view illustrating the structure of an antenna according to the fourth embodiment of the present invention.

An antenna according to the fourth embodiment of the present invention is illustrated in FIG. 13. FIG. 13 is a plan view illustrating the structure of the antenna 220 of the present embodiment. The antenna 220 of this embodiment is configured to be an array antenna in which four antenna elements 10 are arranged in each of two lines (4×2 pattern) on the dielectric substrate 221, and rims 222, 223 are provided at left and right sides of the antenna. The rims 222, 223 are arranged symmetrical or asymmetrical with respect to the antenna elements 10 in 4×2 pattern in the X direction. The rims 222, 223 may be metal plates or EBGs. The reference numerals 224, 225 denote Σ port and Δ port, respectively. The antenna 220 is used as a receiving antenna for radar device.

Figure 14A:
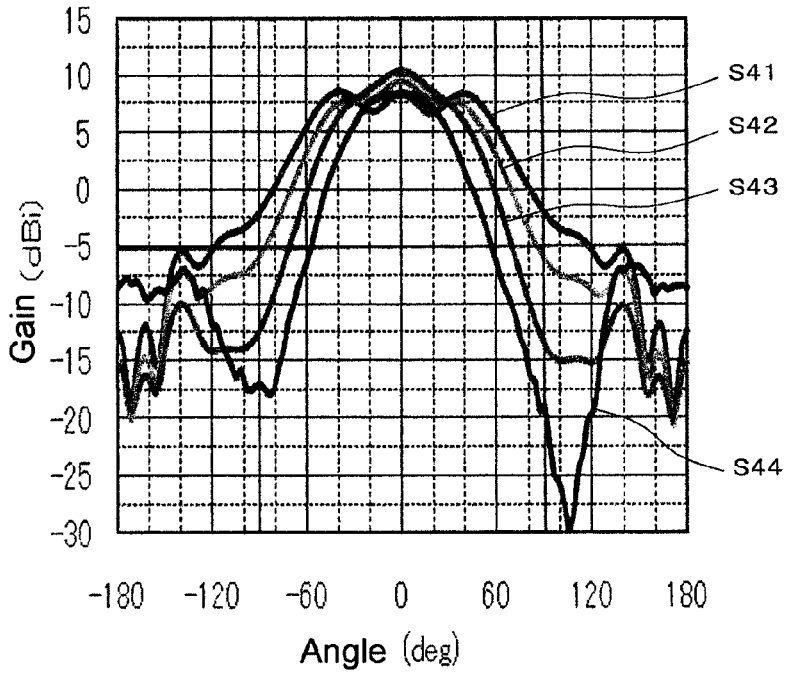
FIGS. 14A and 14B are graphs showing sum and difference patterns of the antenna according to the fourth embodiment.
Figure 14B:
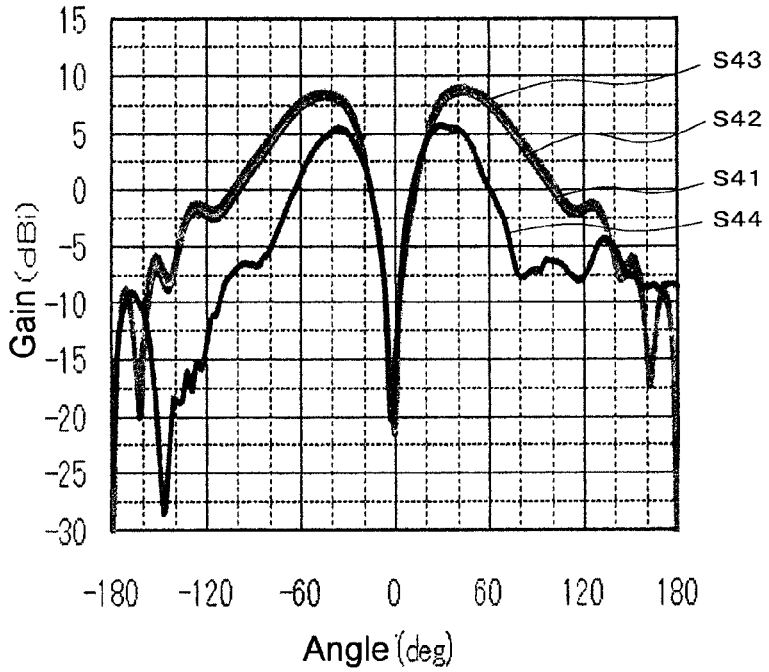
Figure 15:
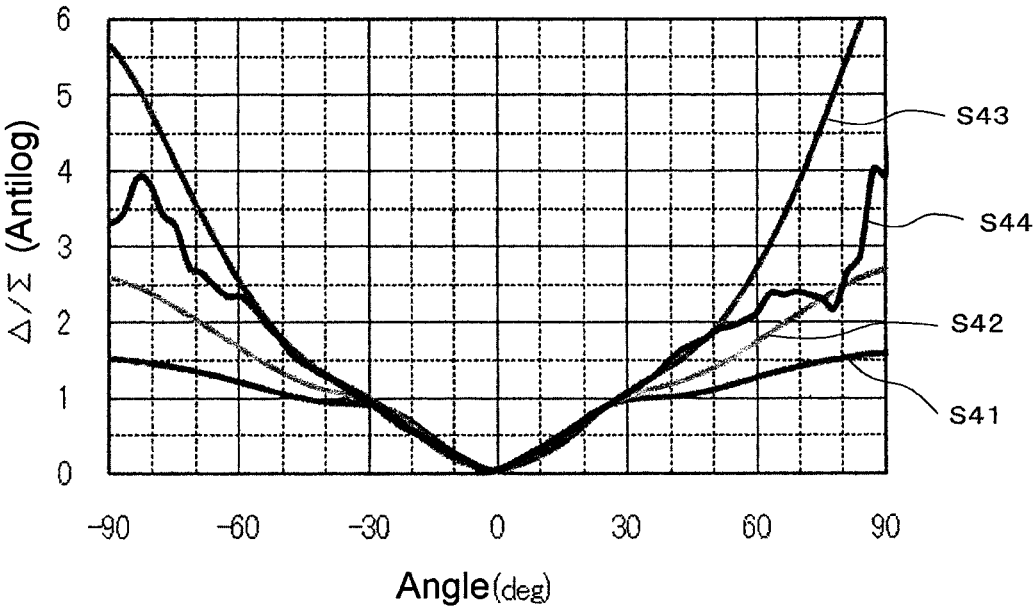
FIG. 15 is a graph showing the discrimination curve of the antenna according to the fourth embodiment.

The radiation characteristics of the antenna 220 of this embodiment are illustrated in FIGS. 14A and 14B. FIG. 14A illustrates Az sum patterns seen from the Σ port 224 and FIG. 14B illustrates Az difference patterns seen from the Δ port 225. S41 to S43 show patterns of the element distances (distance between feed points) dx of 4.75 mm, 5.66 mm, 6.22 mm, respectively. And S44 indicates the characteristics of the conventional array antenna 900*b* shown in FIG. 30B for comparison. Further, FIG. 15 shows calculation results of the discrimination curves from the sum and difference patterns shown in FIG. 14. From the discrimination curves shown in FIG. 15, the array antenna 220 of the present embodiment clearly realizes a wider coverage of angle measurable range as compared with that of the conventional array antenna 900*b*. Furthermore, as there is little effect on the angle measurable range by changing of the element distance dx as mentioned above, the beam width can be changed to some degrees by changing the element distance dx.

As an example, when the gain of angle 0 degree and the gain of angle ±60 degrees are compared in the sum pattern shown in FIG. 14A, the conventional array antenna 900*b* shows deterioration of −15 dB, while the array antenna 220 of the present embodiment at dx=5.66 mm shows deterioration of only −5.5 dB. This means that S/N is improved by the wider coverage.

Further, as to the discrimination curve illustrated in FIG. 15 required for direction finding, in the conventional array antenna 900*b*, the linearity deteriorates at ±60 degrees, and the direction finding becomes ambiguous at angles greater than ±60 degrees. On the other hand, the discrimination curve of the array antenna 220 of the present embodiment can be used for direction finding over a range of ±90 degrees, which shows realization of a wider coverage for direction finding.

As above described, there is little effect on the angle-measurable range even when the element distance dx varies to some degrees. Next description is made about the adjustable range as the width Asub of the dielectric substrate 221. As shown in FIG. 13, when the distance between the feed point to an adjacent rim is S, the width Asub of the dielectric substrate 221 is expressed by:

$$A\text{sub} = dx + S \times 2$$

Figure 16A:
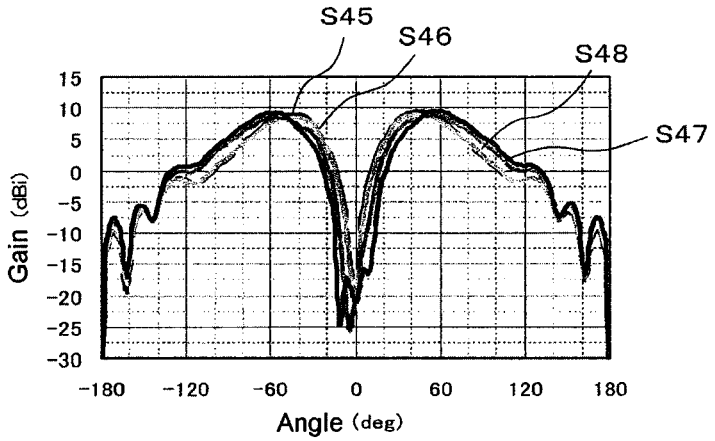
FIGS. 16A and 16B are graphs showing monopulse difference patterns and discrimination curve when the distance between the feed point and rim varies.
Figure 16B:
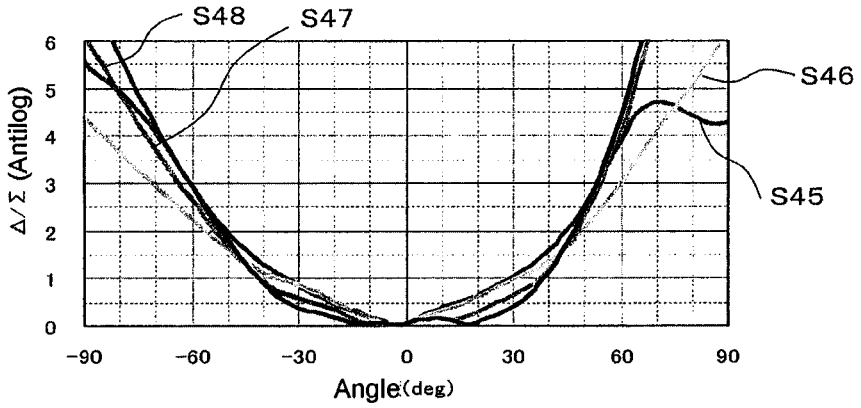

Here, FIGS. 16A and 16B show monopulse difference patterns and discrimination curves at dx=5.66 mm and with S varying. Here, the simulation results are shown with S of 2.5 mm (S45), 3.5 mm (S46), 4.5 m (S47) and 5 mm (S48). At S=2.5 mm, the symmetric property of the discrimination curve is lost and suitable angle characteristics cannot be obtained. And it is also seen that, at S=4.5 mm or more, the null point of the monopulse difference pattern is shifted from 0 degree. From this, the permissible range of Asub/λ0 is given by the following (3).

$$0.95 < A\text{sub}/\lambda 0 < 1.3 \quad (3)$$

Figure 17:
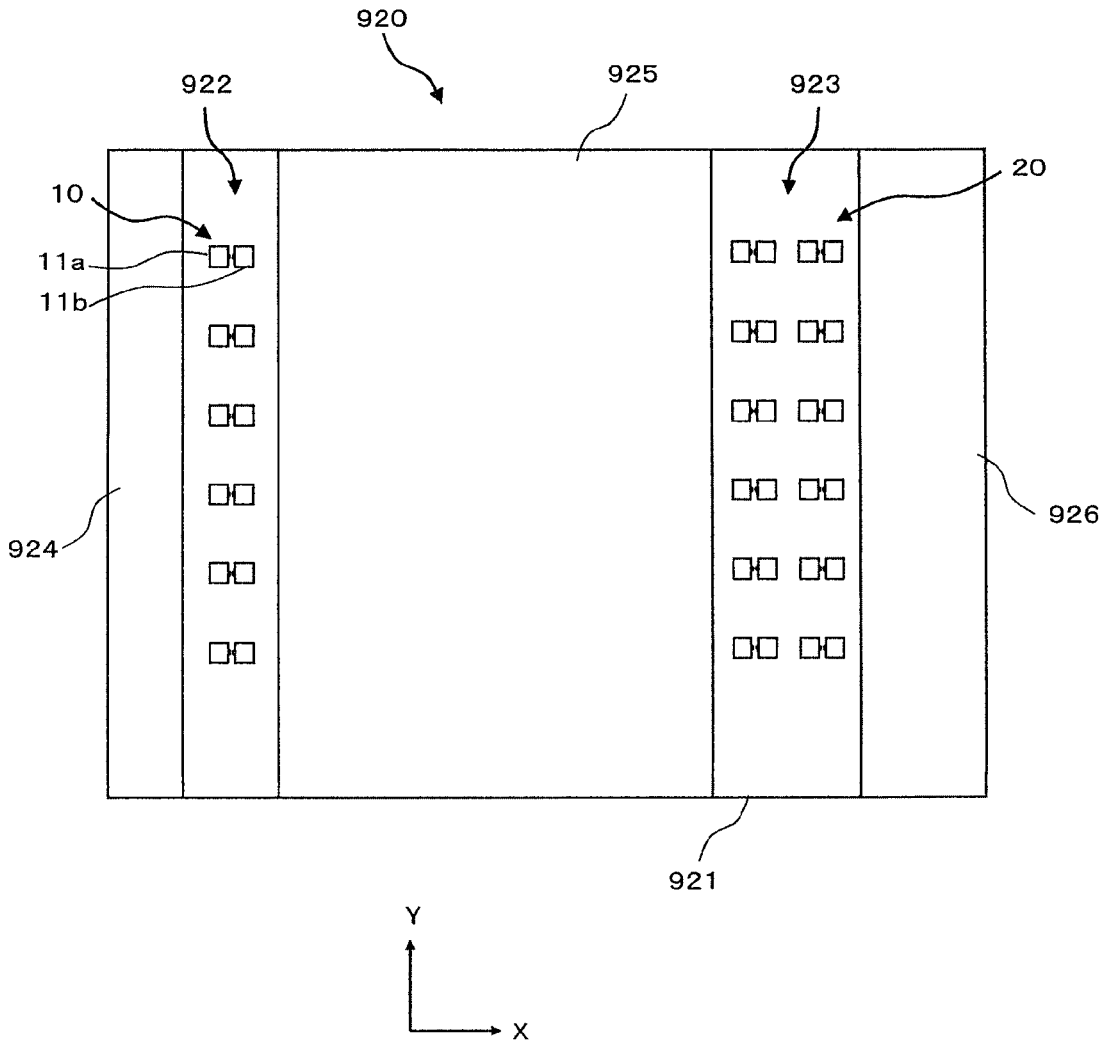
FIG. 17 is a plan view illustrating an example of a conventional combination antenna.

Next description is made about a combination antenna in which a transmission antenna and a receiving antenna are arranged on the same dielectric substrate. First, an example of the combination antenna prior to improvement of the present invention is described with reference to FIG. 17. FIG. 17 is a plan view illustrating the structure of the combination antenna 920 prior to improvement. The combination antenna 920 has the transmission antenna 922 arranged at the left (−X direction) of the dielectric substrate 921 and the receiving antenna 923 arranged at the right (+X direction) of the dielectric substrate 921. Besides, metal plates 924, 925 and 926 are arranged at the left of the transmission antenna 922, between the transmission antenna 922 and the receiving antenna 923, and at the right of the receiving antenna 923.

The transmission antenna 922 has six antenna elements 10 arranged in a 6×1 pattern in the vertical direction (Y direction) in such a manner that the Eθ component is horizontal. Besides, the receiving antenna 923 has six monopulse antennas 20 each with horizontally arranged two antenna elements 10 arranged in the vertical direction in a 6×2 pattern.

Figure 18A:
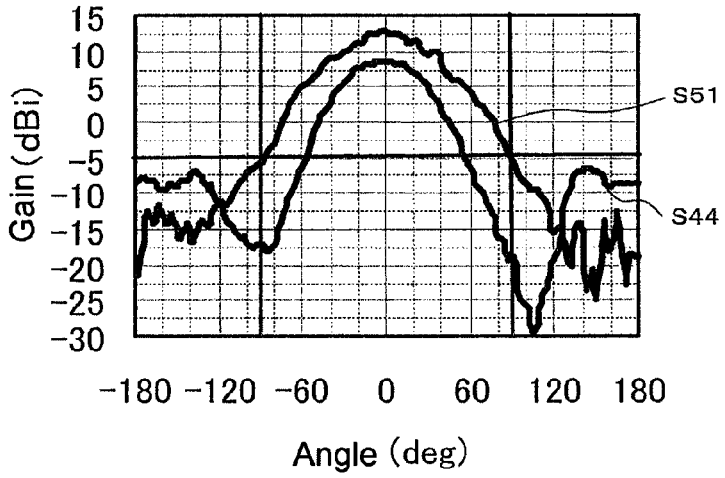
FIGS. 18A to 18C are graphs showing sum and difference patterns and discrimination curve of the receiving antenna of the conventional combination antenna.
Figure 18B:
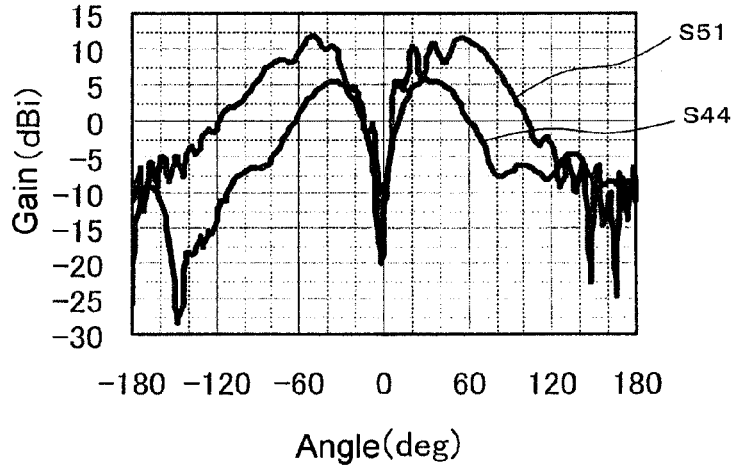
Figure 18C:
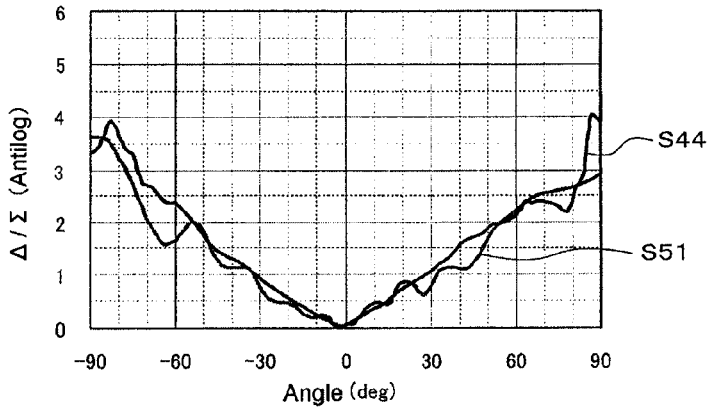

In the combination antenna 920 prior to improvement in which the transmission antenna 922 and the receiving antenna 923 composed of antenna elements 10 arranged with the Eθ component horizontal are arranged on the dielectric substrate 921 in the horizontal direction, TM surface wave having electric field vertical to the radiating elements 11 (11*a*, 11*b*) propagates. As a result, the monopulse sum and difference patterns of the receiving antenna 923 are overlapped with fine ripples as illustrated in FIGS. 18A and 18B by S51. Besides, as illustrated in FIG. 18C, such an effect appears in the discrimination curve used in direction finding, causing ambiguity in measured angles. Here, in FIGS. 18A to 18C, the pattern of the conventional vertically polarized wave array antenna 900*b* illustrated in FIG. 30 for comparison is shown by S44.

Figure 19A:
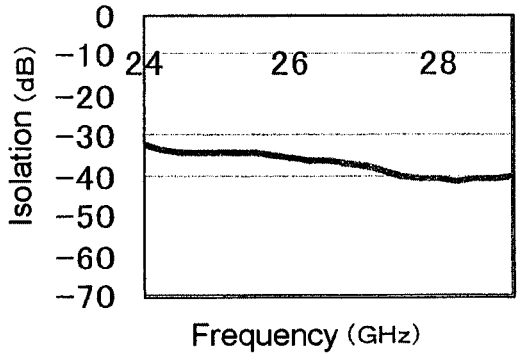
FIGS. 19A and 19B are graphs showing isolation between the transmission antenna and the receiving antenna of the conventional combination antenna.
Figure 19B:
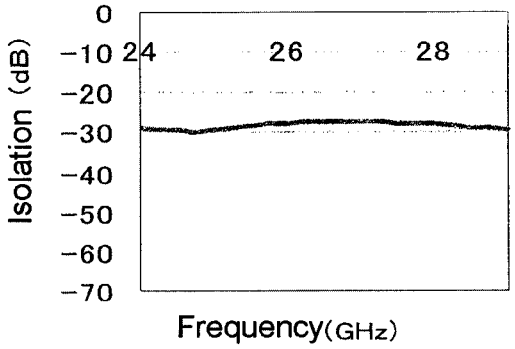

Further, FIGS. 19A and 19B illustrate isolation between the transmission antenna 922 and the receiving antenna 923 with regard to monopulse sum pattern and the monopulse difference pattern. In these figures, insufficient isolation of −30 dB between the transmission antenna 922 and the receiving antenna 923 is shown, and such poor isolation causes an increase in ripples.

Then, for the purpose of suppressing mutual coupling between the transmission antenna and the receiving antenna (enhancing isolation), there is known a method of arranging an EBG between the transmission and receiving antennas (reference document: Okagaki et al. "A Consideration on MSAs with Electromagnetic-Band-Gap structure" IEICE Technical Report A, p 2005-127 (2005 December)). When the EBG is formed with a smaller cycle than the wavelength of the electromagnetic wave, the electromagnetic wave becomes unable to exist in the structure depending on frequencies, and it is possible to interrupt the electromagnetic wave. The TM surface wave that is likely to occur on the dielectric substrate mounted on a large reflecting plate can be also reduced by using the above-mentioned EBG, thereby enabling to suppress unnecessary radiation.

However, in the combination antenna with the monopulse array antenna that needs sum/difference patterns for direction finding, mere arrangement of EBG around the transmission and receiving antennas causes a problem of symmetric property of an element pattern that forms sum and difference patterns, further causing degradation in null depth, null shift and the like required for direction finding.

Figure 20:
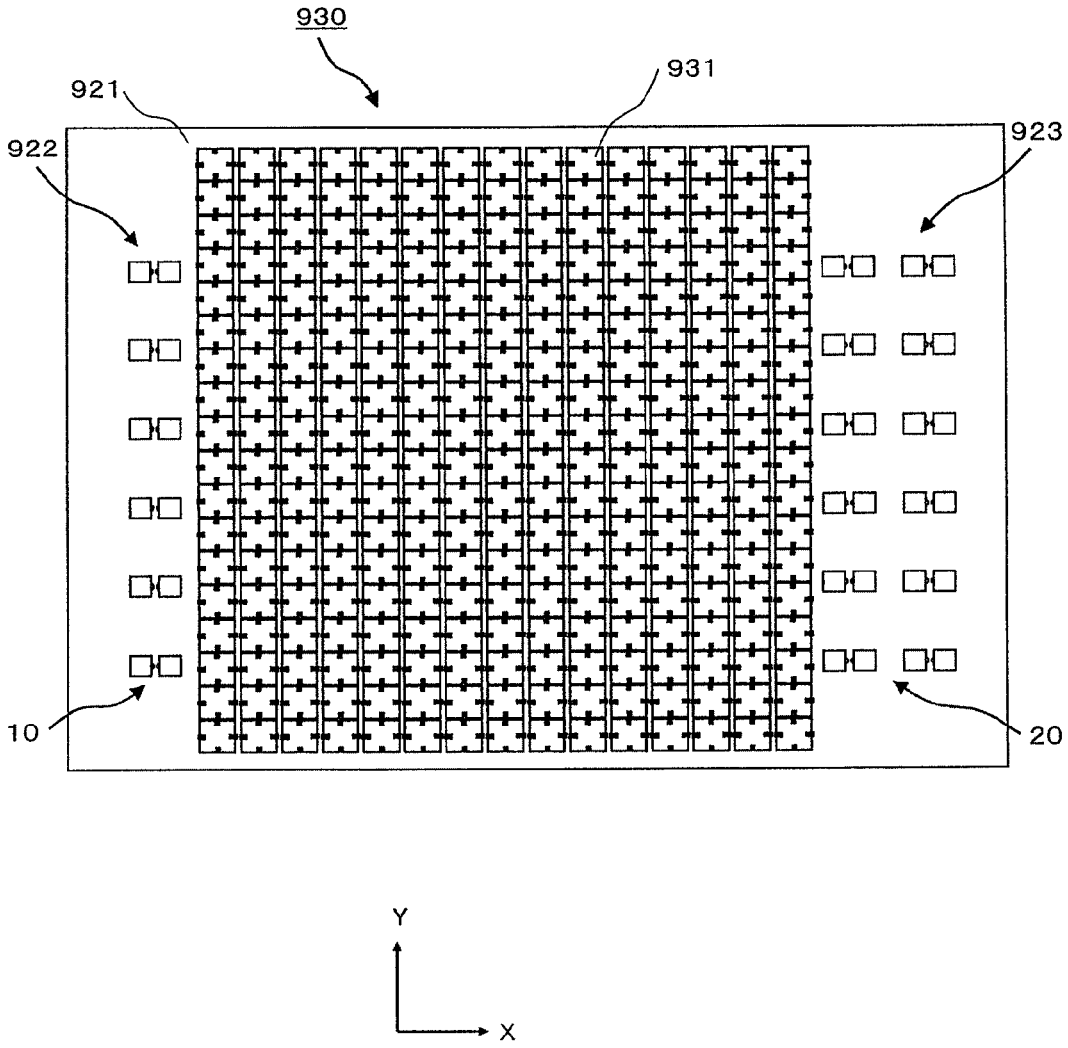
FIG. 20 is a plan view illustrating an example of another conventional combination antenna.
Figure 21A:
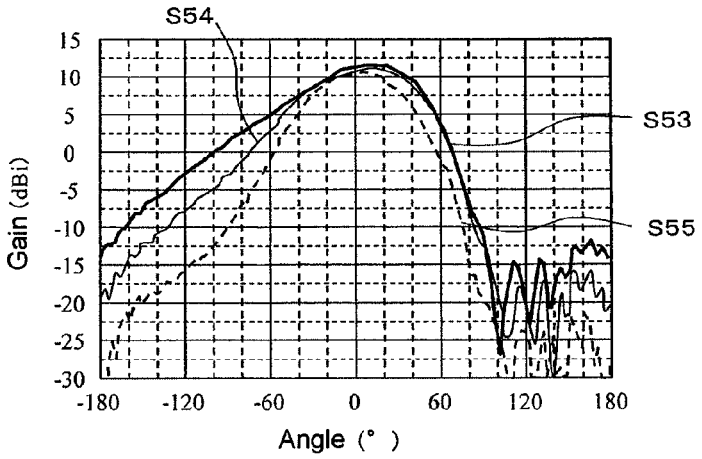
FIGS. 21A to 21C are graphs showing sum and difference patterns and discrimination curve of the receiving antenna of the another conventional combination antenna.
Figure 21B:
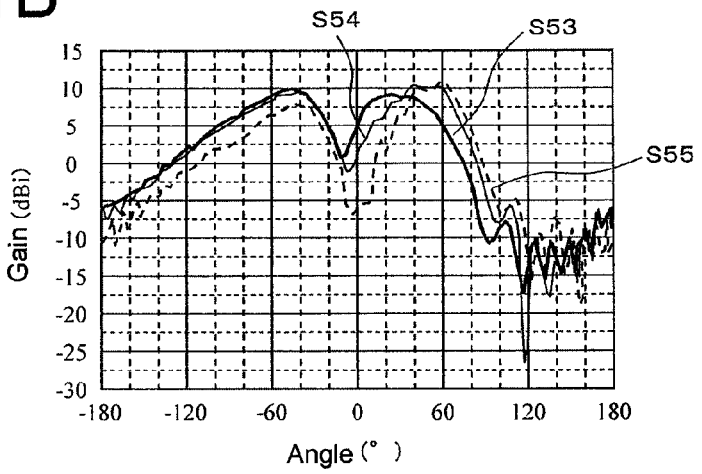
Figure 21C:
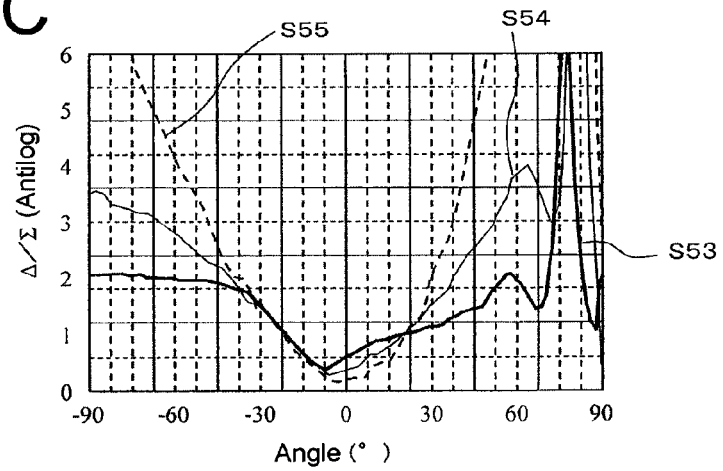

FIG. 20 is a plan view of an example of a combination antenna 930 in which an EBG 931 is arranged between the transmission antenna 922 and the receiving antenna 923 of the combination antenna 920 prior to improvement shown in FIG. 17. Besides, FIGS. 21A to 21C show simulation analysis results of the discrimination curve, monopulse difference pattern and monopulse sum pattern of the receiving antenna 923 of the combination antenna 930. In these figures, the patterns of frequencies 25 GHz, 26.5 GHz and 28 GHz are indicated by S53, S54 and S55.

As illustrated in FIG. 21, as the EBG 931 is arranged between the transmission antenna 922 and the receiving antenna 923, the ripple by the surface wave is relatively reduced. However, the difference pattern shown in FIG. 21B required for angle measuring has great frequency characteristics, the null depth is insufficient and null shift appears. As a result, as illustrated in FIG. 21C, the discrimination curve used to determine an azimuthal angle does not have enough linearity, a minimum value is not found at the angle 0 degree, and there occurs bias error. When using such discrimination curve, there occurs an error in measuring azimuthal angles. In the combination antenna with EBG 931, there is need to improve the characteristics of the difference pattern.

The degradation of the difference pattern as mentioned above seems to be caused by occurrence of difference in radiation pattern between the left and right antenna elements 10 due to end surface effects of the dielectric substrate 921 and the EBG 931 in each monopulse antenna 20 that comprises the receiving antenna 923. The direct factor is such that there is a great difference in the electric boundary conditions seen left and right (in the X direction) from the position of each of the paired antenna elements 10 due to the end surface effects of the dielectric substrate 921 and the EBG 931.

Figure 22A:
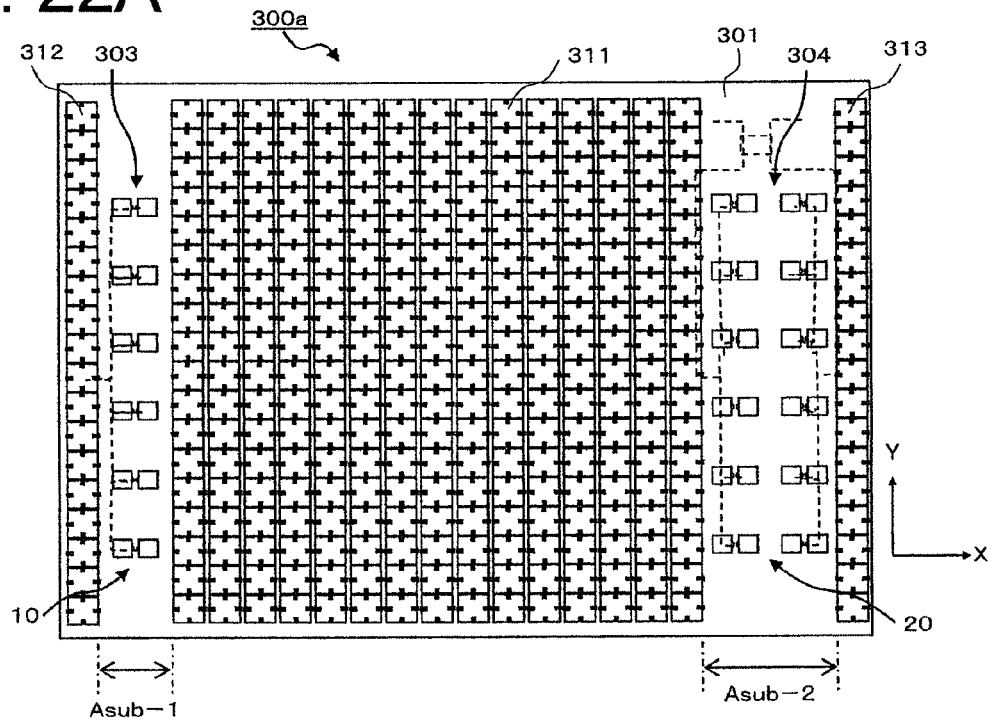
FIGS. 22A to 22B are plan views each illustrating the structure of a combination antenna according to the first embodiment of the present invention.

In the combination antenna according to the fifth embodiment of the present invention, arrangement of the EBG is determined suitably. FIG. 22 is a plan view of the combination antenna of the present embodiment. The combination antenna 300*a* of the present embodiment shown in FIG. 22A has a transmission antenna 303 arranged at the left (−X direction) of the dielectric substrate 301 and a receiving antenna 304 arranged at the right (+X direction) of the dielectric substrate 301. The transmission antenna 303 has six antenna elements 10 arranged in the vertical direction (Y direction) in a 6×1 pattern in such a manner that the Eθ component is horizontal. The receiving antenna 304 has six monopulse antennas 20 each with horizontally arranged two antenna elements 10 arranged in the vertical direction in a 6×2 pattern.

In the combination antenna 300*a* of the present embodiment, the EBG 311 is arranged between the transmission antenna 303 and the receiving antenna 304, and at both end surfaces of the dielectric substrate 301 at the left of the transmission antenna 303 and at the right of the receiving antenna 304, EBGs 312 and 313 are arranged respectively. With this configuration, the EBG 311 and the EBG 313 are arranged at both sides of the receiving antenna 304, respectively. The distance between the EBG 312 and the EBG 311 as a substrate width Asub-1 of the transmission antenna 303 is set to meet the equation (2). And, the distance between the EBG 313 and the EBG 311 as the substrate width Asub-2 of the receiving antenna 304 is set to meet the equation (3).

Figure 22B:
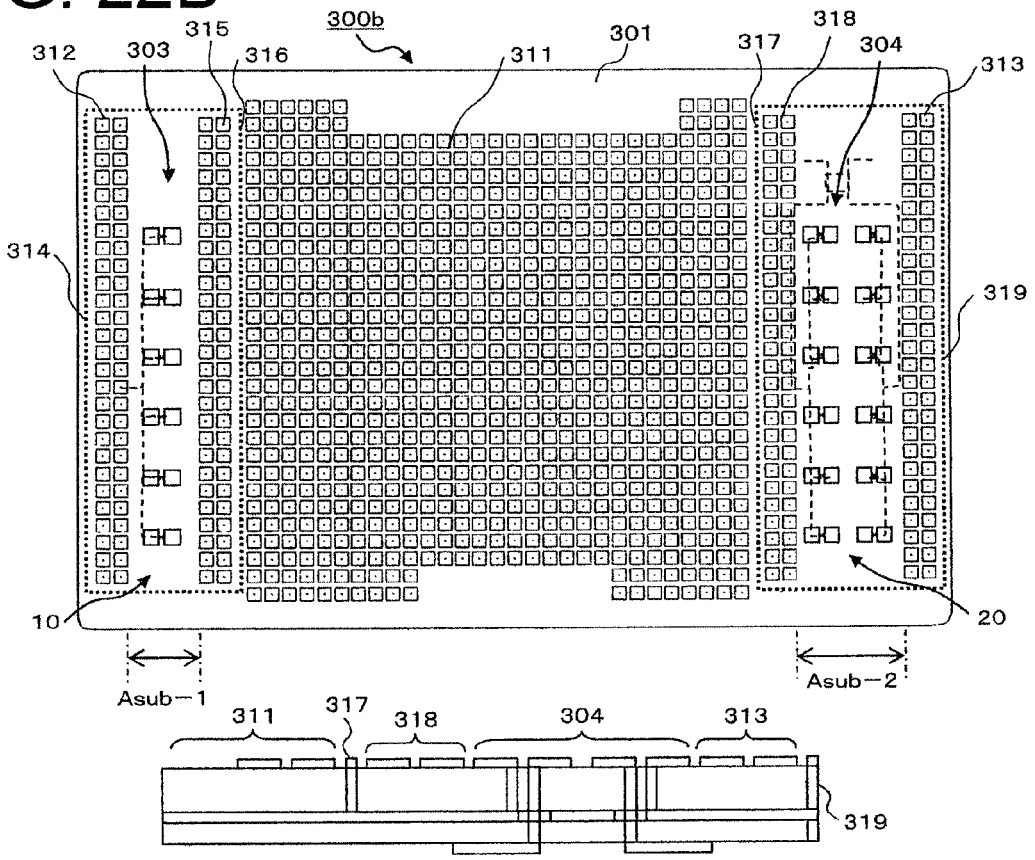

In the combination antenna 300*b* of the present embodiment shown in FIG. 22B, as compared with the combination antenna 300*a* of the present embodiment shown in FIG. 22A, EBGs 315, 318 and rims 314, 316, 317, 319 are further arranged. Specifically, the rims 314, 319 are arranged between the both end surfaces of the dielectric substrate 301 and the EBGs 312, 313, respectively, the EBG 315 and the rim 316 are arranged between the transmission antenna 303 and the EBG 311, and the rims 317 and the EBG 318 are arranged between the EBG 311 and the receiving antenna 304. The distance between the EBG 312 and the EBG 315 as the substrate width Asub-1 of the transmission antenna 303 is set to meet the equation (2) and the distance between the EBG 313 and the EBG 318 as the substrate width Asub-2 of the receiving antenna 304 is set to meet the equation (3).

In the above-described arrangement, the rim 314 and the EBG 312 are arranged at the left of the transmission antenna 303 and the EBG 315 and the rim 316 are arranged at the right of the transmission antenna 303 so that they are symmetrical with respect to the transmission antenna 303. In the same way, the rim 317 and the EBG 318 are arranged at the left of the receiving antenna 304 and the EBG 313 and the rim 319 are arranged at the right of the receiving antenna 304 so that they are symmetrical with respect to the receiving antenna 304. As the transmission antenna 303 and the receiving antenna 304 are positioned symmetrically in the horizontal direction, the combination antenna 300*b* of the present embodiment ensures electric wave symmetric property. That is, the electric wave conditions can be close to those seen right and left from each of antenna elements 10 that form the transmission antenna 303 and the receiving antenna 304 as illustrated in FIG. 4, for example. Consequently, improvement of symmetric property of the difference pattern can be expected.

Figure 23:
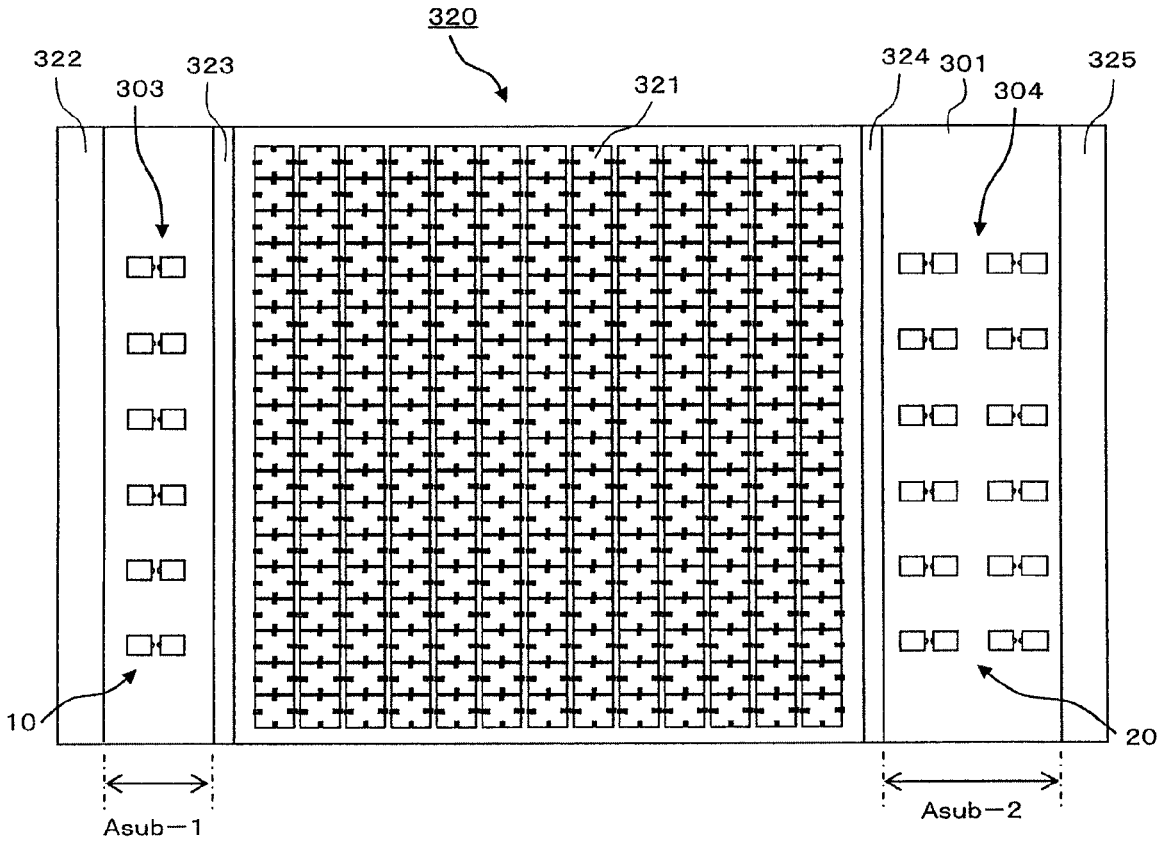
FIG. 23 is a plan view illustrating the structure of a combination antenna according to the second embodiment of the present invention.

Further, FIG. 23 illustrates a combination antenna 320 according to the sixth embodiment of the present invention. FIG. 23 is a plan view illustrating the combination antenna 320 of the present embodiment. In the combination antenna 320 of the present embodiment, rims 322, 323 and rims 324, 325 are arranged in such a manner as to sandwich the transmission antenna 303 and the receiving antenna 304, respectively. And, an EBG 321 is arranged between the rim 323 at the transmission antenna 303 side and the rim 324 at the receiving antenna 304 side. The rims 322 to 325 are made of metal plates. Also in this embodiment, the distance between the rims 322, 323 as the substrate width Asub-1 of the transmission antenna 303 is set to meet the equation (2), and the distance between the rims 324, 325 as the substrate width Asub-2 of the receiving antenna 304 is set to meet the equation (3).

Figure 24:
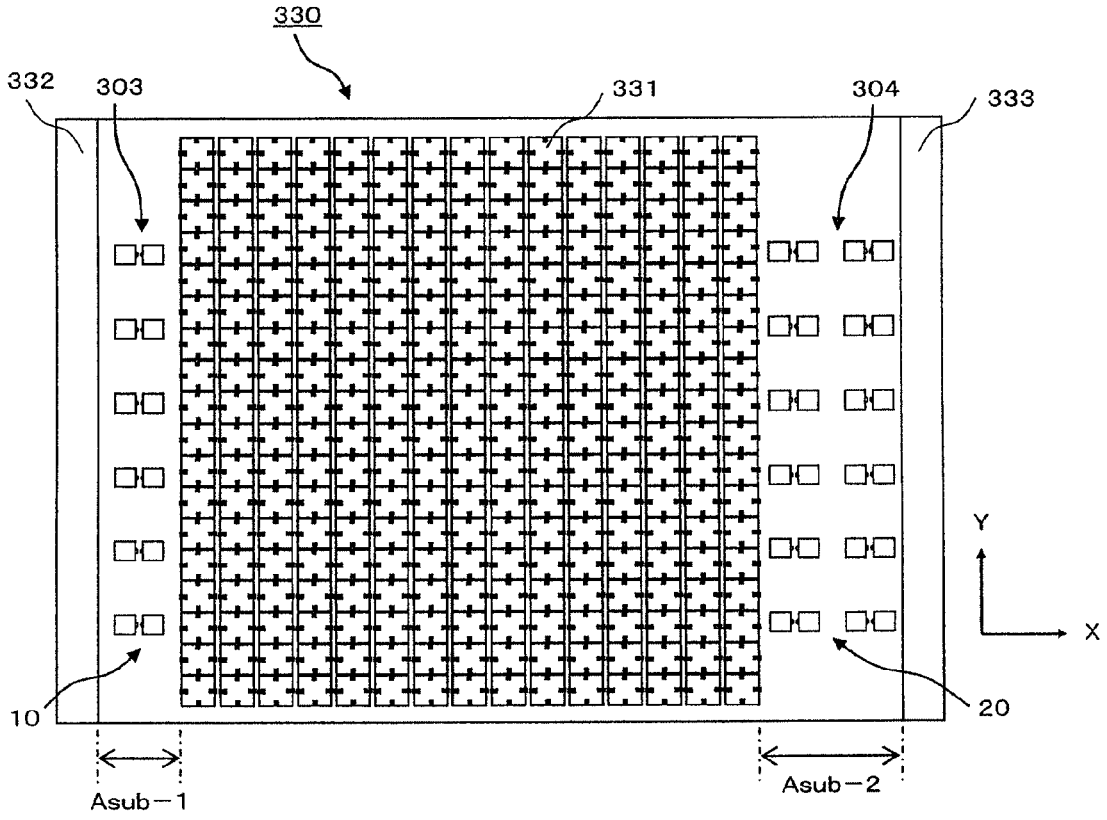
FIG. 24 is a plan view illustrating the structure of a combination antenna according to the third embodiment of the present invention.

Further, a combination antenna 330 according to the seventh embodiment of the present invention is shown in FIG. 24. FIG. 24 is a plan view illustrating the structure of the combination antenna 330 of the present embodiment. In the combination antenna 330 of this embodiment, an EBG 331 is arranged between a transmission antenna 303 and a receiving antenna 304, and rims 332 and 333 are arranged at both end surfaces of the dielectric substrate 301 at the right of the receiving antenna 304 and at the left of the transmission antenna 303. The rims 332, 333 are both made of metal plates.

Also in this embodiment, the distance between the rim 333 and the EBG 331 as the substrate width Asub of the receiving antenna 304 is determined to meet the equation (3).

In each of the combination antennas 300*a*, 300*b*, 320 and 330 according to the fifth to seventh embodiment as described above, the EBGs or rims of metal plates are arranged at right and left sides of each of the transmission antenna 303 and the receiving antenna 304. As compared with the combination antenna 300*a* of the fifth embodiment, the combination antenna 320 of the sixth embodiment is different in that the rims 322 and 325 are arranged at right and left sides of the dielectric substrate 301, instead of the EBGs 312, 313 and the rims 323, 324 are arranged between the transmission antenna 303 and the EBG 321 and between the receiving antenna 304 and the EBG 321, respectively. In addition, the combination antenna 330 of the seventh embodiment is different in that the rims 332, 333 are arranged at right and left sides of the dielectric substrate 301, instead of the EBGs 312, 313.

Figure 25A:
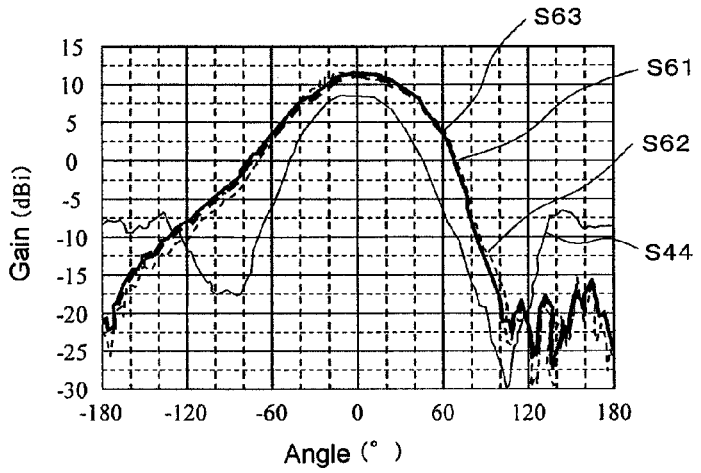
FIGS. 25A to 25C are graphs showing sum and difference patterns, discrimination curve of the receiving antenna of the combination antenna according to the first to third embodiments.
Figure 25B:
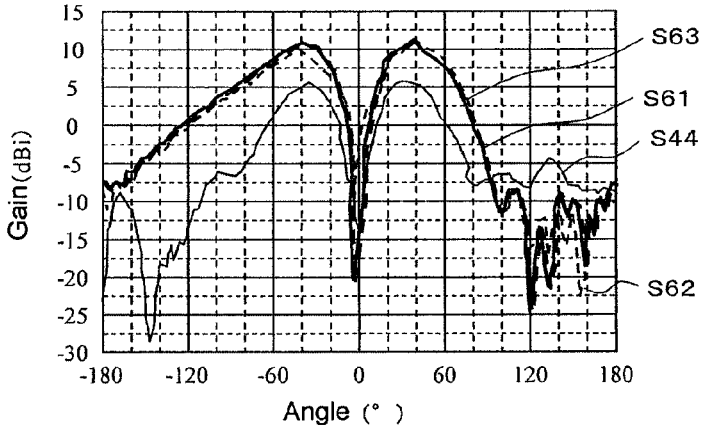
Figure 25C:
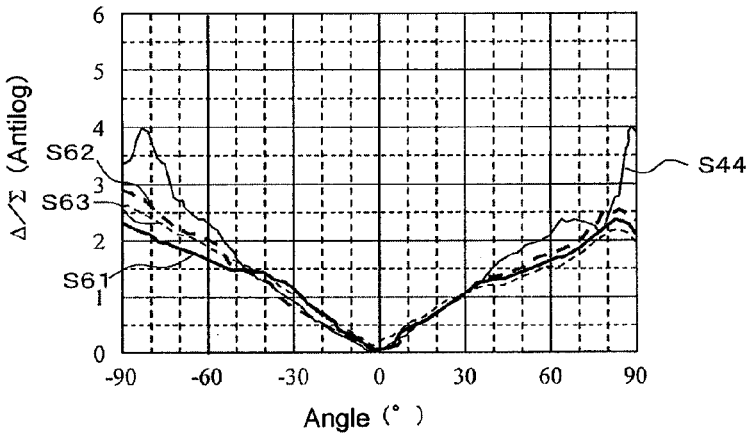

As to the combination antennas 300*a*, 320, 330 shown in FIGS. 22A, 23 and 24, the sum pattern, difference pattern and discrimination curve of the receiving antenna 304 are simulation analyzed and compared, which is shown in FIGS. 25A, 25B and 25C. Here, the codes S61, S62 and S63 represent analysis results of the combination antennas 300*a*, 320 and 330, respectively. For comparison, the pattern of the conventional array antenna 900*b* is shown by the code S44. As shown in this figure, in each of the combination antennas 300*a*, 320 and 330 according to the fifth to seventh embodiments of the present invention, the sum pattern, difference pattern and discrimination curve are excellent and no large difference is found between these structures.

In addition, as compared with the difference pattern and discrimination curve of the combination antenna 920 prior to improvement of the present invention without using any EBG as shown in FIGS. 18B and 18C, the combination antennas 300*a*, 320 and 330 show greatly improved ripples of the difference pattern and linearity of the discrimination curve, which is clear from FIGS. 25B and 25C. Further, as shown in FIG. 25B, it is confirmed that the null depth and null shift of the difference pattern is also greatly improved. As FIG. 25 also shows each pattern (S44) using the conventional vertically polarized wave array antenna 900*b*, as compared with this antenna, the gain is improved at ±90 degrees and the ambiguity about the angle of the discrimination curve required for direction finding is also lost. According to the combination antennas 300*a*, 320 and 330 of the fifth to seventh embodiments, it is possible to realize the receiving antenna 304 capable of measuring angles over a wide range.

On the surface of the dielectric substrate 301 opposite to the surface on which the transmission antenna 303 and the receiving antenna 304 are mounted, the respective antenna feed circuits are mounted. If the transmission/reception micro wave integrated circuit (MIC) is mounted also on the back surface of the substrate between the transmission antenna 303 and the receiving antenna 304, it is necessary to reduce interference between the antenna feed circuits and the MIC. In order to reduce such interference, the combination antenna 320 of the sixth embodiment and the combination antenna 300*b* of the fifth embodiment are more preferable than the combination antenna 300*a* of the fifth embodiment and the combination antenna 330 of the seventh embodiment. This reason is explained representatively with use of the sixth embodiment below.

Figure 26:
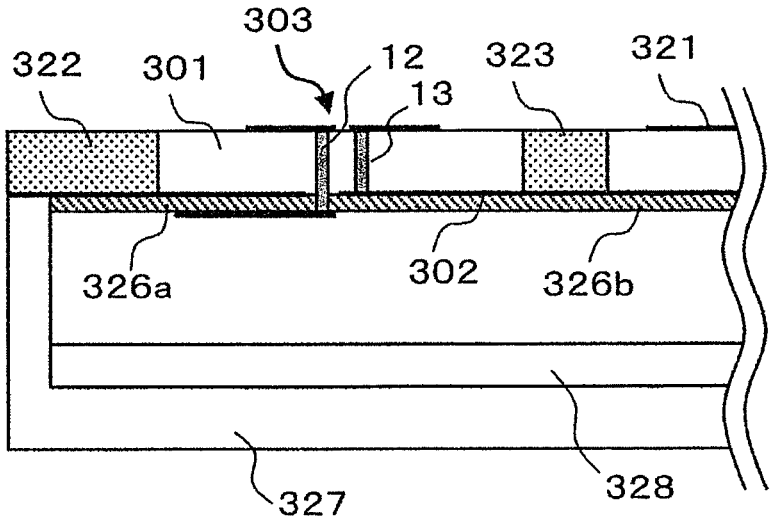
FIG. 26 is a cross sectional view of the combination antenna according to the second embodiment.

FIG. 26 is a cross sectional view of the combination antenna 320 of the sixth embodiment. Here, the transmission antenna 303 and the rims 322, 323 arranged at the left and right thereof are only illustrated, but the following description goes the same for the receiving antenna 304 and the rims 324, 325 arranged at the left and right thereof. On the surface of the dielectric substrate 301 opposite to the surface where the transmission antenna 303 is mounted, the ground plane 302 is formed and the MIC board (RF circuit board) 326 (326*a* 326*b*) is arranged in such a manner as to sandwich the ground plane 302. Further, a metal housing 327 for protecting the MIC board 326 is provided and an absorber 328 is arranged on the inner surface of the metal housing 327.

In FIG. 26, an area positioned below the antenna element 10 of the MIC boards 326 is indicated by the numeral 326*a* and an area positioned below the EBG 321 is indicated by the numeral 326*b*. On the area 326*a* of the MIC board 326, the antenna feed circuit is mounted. In the combination antenna 320 of the sixth embodiment, the second pole 13 and the rims 322 to 325 pass through the dielectric substrate 301 and are connected to the ground plane 302.

Figure 27:
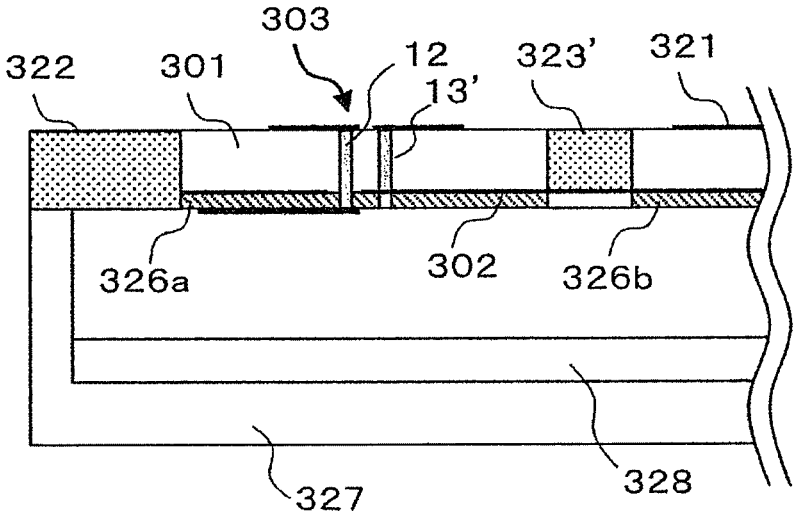
FIG. 27 is a cross sectional view illustrating the structure of the combination antenna according to the second embodiment, in which poles and rims are formed through the MIC board.

When the combination antenna 320 is manufactured by an integrated substrate, the poles 12, 13 and the rims 322 to 325 are actually composed of through holes. Then, as illustrated in FIG. 27, not only the first pole 12, but also the second pole 13 and the rims 322, 323, 324 (not shown) are formed to pass through the MIC board 326 for easy manufacturing. In the following, the second pole 13 and the rim 323 passing through the MIC board 326 are called a through pole 13' and a through rim 323'. According to the simulation analysis, the through pole 13' and the through rim 323' passing through the MIC board 326 have little effect on the radiation characteristics.

As the combination antenna 320 is thus structured, the MIC board 326 can be electrically separated from the areas 326*a* and 326*b* by the through rim 323'. With this structure, it is possible to reduce interference between the transmission antenna 302 and the transmission/reception MIC when the transmission/reception MIC is built on the area 326*b*.

For the reasons described above, in the combination antenna having the transmission antenna 303 and the receiving antenna 304, as compared with the combination antennas 300*a* and 330 of the fifth embodiment and the seventh embodiment, the combination antenna 320 of the sixth embodiment or the combination antenna 300*b* of the fifth embodiment is more preferable. However, if the transmission antenna 303 and the receiving antenna 304 are configured separately, the combination antenna 300*a* of the fifth embodiment or the combination antenna 330 of the seventh embodiment without rims 323, 324, 314, 315, 317, 319 are characteristically easier in structure and manufacturing.

Each of the embodiments of the present invention has been described by way of example where the antenna elements 10 are the printed dipole antenna. The present invention is not limited to this example. In the case of using antenna elements of which the wave source is magnetic current, the antenna and combination antenna of the present invention can be applied. As an example, the excitation method of the patch antenna is different from that of the printed dipole antenna, however the electromagnetic field distribution after excitation is fundamentally the same in action as that of the printed dipole antenna illustrated in FIG. 3. Needless to say, the patch antenna includes the coaxial feed system, the coplanarity feed system by micro strip line and electromagnetic coupling feed system. For illustrative purpose, an example of the present invention of the patch antenna by electromagnetic coupling is shown in FIGS. 28 and 29.

In the antenna element 10 of the printed dipole antenna shown in FIGS. 1A to 1C, the radiating elements 11 (11*a*, 11*b*) are connected to the transmission line 104 via the pole 12. In the meantime, in an antenna 340*a* shown in FIGS. 28A and 28B and an antenna 340*b* shown in FIGS. 29A and 29B, an antenna element 341 and a transmission line 345 are connected through an electromagnetic coupling hole 346 provided in the ground plane 343 with use of mutual induction of the electromagnetic field. Accordingly, this antenna is called electromagnetic coupling type patch antenna.

Figure 28A:
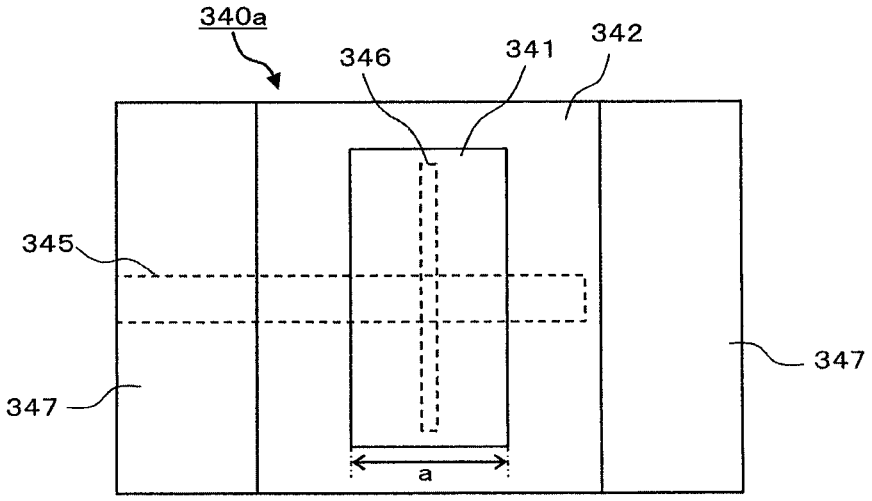
FIGS. 28A and 28B are explanatory views illustrating the structure of a patch antenna by electromagnetic coupling according to an example of the present invention.
Figure 28B:
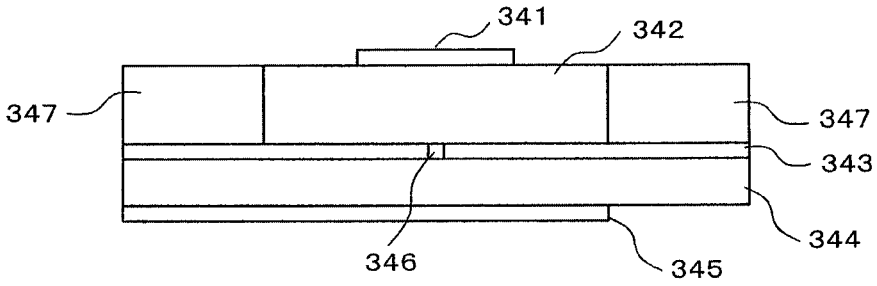

FIGS. 28A and 28B are a plan view and a cross sectional view of the antenna 340*a*. The antenna 340*a* has the antenna element 341 formed on the dielectric substrate 342 and rims 347 of metal plates arranged symmetrically at both sides in such a manner as to sandwich the antenna element 341. The two rims 347 are electrically connected to the ground plane 343. Another dielectric substrate 344 is arranged on the surface of the ground plane 343 opposite to the dielectric substrate 342 in such a manner that the ground plane 343 is placed between the dielectric substrates 342 and 344. On the dielectric substrate 344, a transmission line 345 is arranged as a micro wave line. The antenna element 341 and the transmission line 345 are connected to each other via an electromagnetic coupling hole 346 provided in the ground plane 343 with use of mutual induction of the electromagnetic field, as described above.

Figure 29A:
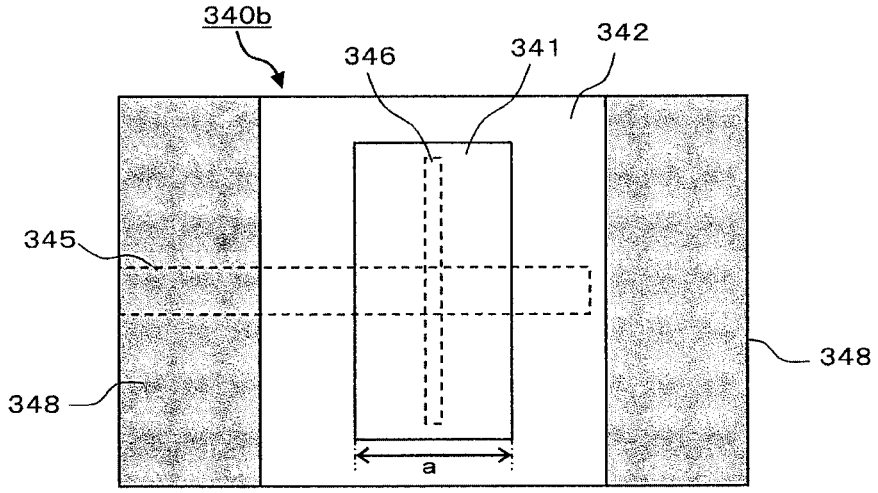
FIGS. 29A and 29B are explanatory views illustrating the structure of a patch antenna by electromagnetic coupling according to another example of the present invention.
Figure 29B:
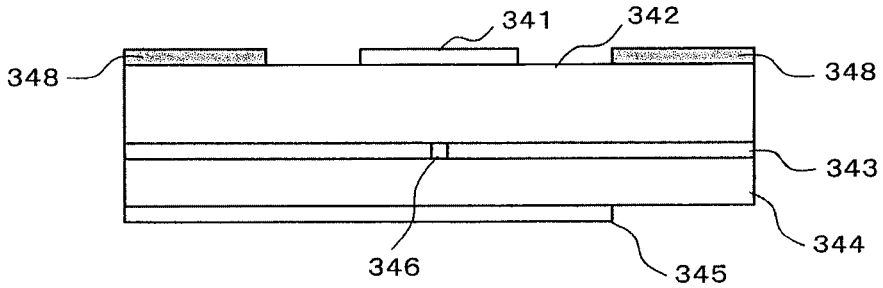

In addition, FIGS. 29A and 29B are a plan view and a cross sectional view of the antenna 340*b*. In the antenna 340*b*, EBGs 348 are arranged at the both sides of the antenna element 341 symmetrically, instead of the rims 347. The EBGs 348 are arranged on the upper surface of the dielectric substrate 342. Other structures are the same as those of the antenna 340*a*.

FIG. 3 illustrates electromagnetic field distribution of the patch antenna and printed dipole antenna. As seen from the figure, the dimension 2a of the patch antenna is generally given by the following equation (4), in which ∈eff is the effective relative permittivity of the dielectric substrate 342 and λ0 is free space wavelength.

$$2a = \frac{1}{2}\frac{\lambda O}{\sqrt{\varepsilon\ eff}} = (1/2)\ (\lambda g) \tag{4}$$

In other words, the dimension 2a is determined to be a half wavelength of the effective wavelength λg in consideration of the effective relative permittivity.

As is clear from the field distribution of the patch antenna shown in FIG. 3, the field on the center y axis is zero. Hence, even when the dimension 2a of the patch is changed to a half, a, the antenna can operate. This is a technique for downsizing the patch antenna, which is also called ¼ wavelength rectangular patch. Its examples are shown in FIGS. 28 and 29.

In this case, the length a of the antenna is given by the following equation.

$$a = \frac{1}{4}\frac{\lambda O}{\sqrt{\varepsilon\ eff}} \tag{5}$$

When such a downsized patch antenna is used as an antenna element in the phase comparison monopulse antenna shown in FIG. 13, the above-mentioned equation (3) needs to be modified in order to achieve an ideal difference pattern.

When the typical patch antenna is downsized, the dimension Q of the downsized phase comparison monopulse antenna is given by the following equation (6)

$$Q=2*(2a-a)=2a \tag{6}$$

Accordingly, when Q is normalized by λ0, the following equation is obtained.

$$\frac{Q}{\lambda O} = \frac{0.5}{\sqrt{\varepsilon\ eff}} \tag{7}$$

Hence, Asub of the phase comparison monopulse antenna suitably downsized as the ¼ wavelength rectangular patch antenna needs to be determined in consideration of the equations (3) to (7).

That is, when the ¼ wavelength rectangular patch antenna is used as the phase comparison monopulse antenna, Asub needs to be determined so as to meet the following equation (8) for the purpose of achieving the ideal difference pattern.

$$0.95-Q/\lambda 0<A\text{sub}/\lambda 0<1.3-Q/\lambda 0 \tag{8}$$

These embodiments have been described by way of example of the antenna and the combination antenna of the present invention and are not intended for limiting the present invention. Detail structures and detail operations of antennas of these embodiments may be modified without departing from the scope of the present invention.

REFERENCE NUMERALS

10, 341 antenna element
11 radiating element
12, 13 pole
20 monopulse antenna element
100, 200, 210, 220, 3401, 340*b* antenna
101, 103, 211, 221, 301, 342, 344 dielectric substrate
102, 302, 343 ground plane
104, 345 transmission line
111, 112, 201, 202, 212, 213, 222, 223, 314, 316, 317, 319, 322-325, 332, 333, 347 rim
224 Σ port
225 Δ port
303 transmission antenna
304 receiving antenna
300*a*, 300*b*, 320, 330 combination antenna
311, 312, 313, 321, 331, 348 EBG
326 MIC board
346 electromagnetic coupling hole

The invention claimed is:

1. An antenna comprising:

a dielectric substrate;

a plurality of antenna elements provided on the dielectric substrate and having magnetic current as a main radiating source, the plurality of antenna elements arranged such that an Eθ component as main polarized waves is placed in a horizontal direction; and rims made of metal plates or EBGs (Electromagnetic band Gap) with a predetermined periodic structure provided at respective sides on the dielectric substrate in such a manner as to sandwich the at least one antenna element in the horizontal direction, wherein the plurality of at least one antenna elements comprise two or more groups of antenna elements arranged in a vertical direction, each of the groups of the antenna elements having two antenna elements arranged in a horizontal direction, and each of the antenna elements being formed as a ¼ wavelength rectangular patch, and when a distance between the rims or EBGs arranged at the respective sides of the two or more groups of the antenna elements is Asub, free space wavelength of radiation wave of the antenna elements is λ0, a relative effective permittivity of the dielectric substrate is ∈eff, and a length a of each of the antenna elements in the horizontal direction meets $$a = \frac{1}{4}\frac{\lambda O}{\sqrt{\varepsilon\ eff}}$$

the Asub is determined to meet $$0.95-2a/\lambda 0<Asub/\lambda 0<1.3-2a/\lambda 0.$$

2. The antenna of claim 1, wherein each of the plurality of antenna elements is a printed dipole antenna or a micro strip antenna (patch antenna).

3. The antenna of claim 1, wherein the two antenna elements of each of the two or more groups are arranged symmetric with respect to a center axis that passes between the two antenna elements and are reverse phase fed.

4. The antenna of claim 1, wherein the rims or EBGs are arranged symmetric or asymmetric with respect to the antenna elements in the horizontal direction.

5. A combination antenna comprising:

a dielectric substrate;

a transmission antenna having a plurality of antenna elements vertically arranged on the dielectric substrate in such a manner that a main radiating source is magnetic current and an Eθ component as main polarized waves is placed in a horizontal direction;

a receiving antenna having two or more groups of the antenna elements vertically arranged on the dielectric substrate, each of the groups having two antenna elements arranged in the horizontal direction;

a center EBG arranged between the transmission antenna and the receiving antenna;

other EBGs arranged between respective end surfaces of the dielectric substrate in the horizontal direction and the center EBG to be symmetric with respect to the transmission antenna and the receiving antenna; and rims arranged between the respective end surfaces and the other EBGs and between the center EBG and the other EBGs.

6. A combination antenna comprising:

a dielectric substrate;

a transmission antenna having a plurality of antenna elements vertically arranged on the dielectric substrate in such a manner that a main radiating source is magnetic current and an Eθ component as main polarized waves is placed in a horizontal direction;

a receiving antenna having two or more groups of the antenna elements vertically arranged on the dielectric substrate, each of the groups having two antenna elements arranged in the horizontal direction;

end-surface rims arranged at both end surfaces of the dielectric substrate in the horizontal direction;

a center EBG arranged between the transmission antenna and the receiving antenna;

another rim arranged between the transmission antenna and the center EBG; and an yet other rim arranged between the receiving antenna and the center EBG, wherein one of the end-surface rims, the transmission antenna, the other rim, the center EBG, the yet other rim, the receiving antenna and the other of the end-surface rims are arranged in the horizontal direction.

7. The combination antenna of claim 6, wherein an RF circuit board is arranged on a surface of the dielectric substrate opposite to the surface where the antenna elements are arranged, in such a manner as to sandwich a ground plane, the other rim and the yet other rim have through holes that pass through the dielectric substrate to be electrically connected to the ground plane, and the through holes pass through the RF circuit board together with another through hole which forms a pole electrically connecting the antenna elements to the ground plane.

8. The combination antenna of claim 7, wherein a transmission/reception micro wave integrated circuit (MIC) or an RF circuit is arranged on an RF circuit board corresponding to a back surface of the center EBG.

9. The combination antenna of any one of claims 5 and 6 to 8, wherein a distance between the adjacent rims or EBGs arranged at both sides of the transmission antenna is Asub-1, a distance between the adjacent rims or EBGs arranged at both sides of the receiving antenna is Asub-2, and free space wavelength of radiation wave of the antenna elements is λ0, the Asub-1 meets 0.65<Asub-1/λ0<0.85, and the Asub-2 meets 0.95<Asub/λ0<1.3.

* * * * *